US011231671B2

(12) United States Patent
Fujisawa

(10) Patent No.: US 11,231,671 B2
(45) Date of Patent: Jan. 25, 2022

(54) IMAGE FORMING APPARATUS PERFORMING WARM-UP OPERATION BY ROTATION OF A MOTOR

(71) Applicant: Oki Data Corporation, Tokyo (JP)

(72) Inventor: Kuniaki Fujisawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/024,173

(22) Filed: Sep. 17, 2020

(65) Prior Publication Data

US 2021/0096492 A1 Apr. 1, 2021

(30) Foreign Application Priority Data

Sep. 30, 2019 (JP) ..... JP2019-180819

(51) Int. Cl.
*G03G 15/00* (2006.01)
*G03G 15/20* (2006.01)

(52) U.S. Cl.
CPC ..... *G03G 15/5008* (2013.01); *G03G 15/2039* (2013.01); *G03G 15/2053* (2013.01); *G03G 15/2064* (2013.01); *G03G 2215/2032* (2013.01)

(58) Field of Classification Search
CPC ..... G03G 15/5008; G03G 15/2064; G03G 15/2039; G03G 15/2032; G03G 15/1615
USPC ..... 399/66, 70, 85, 317
See application file for complete search history.

(56) References Cited

U.S. PATENT DOCUMENTS 5,493,377 A * 2/1996 Nishikawa ..... G03G 15/2028 399/322

FOREIGN PATENT DOCUMENTS

| | | | |
|---|---|---|---|
| JP | 2007-057652 | A | 3/2007 |
| JP | 2009036856 | A | 2/2009 |
| JP | 2014122960 | A | 7/2014 |
| JP | 2015212718 | A | 11/2015 |
| JP | 2017090659 | A | 5/2017 |

* cited by examiner

*Primary Examiner* — Arlene Heredia
(74) *Attorney, Agent, or Firm* — Rabin & Berdo, P.C.

(57) ABSTRACT

An image forming apparatus includes a motor, an image formation-transfer section, a switching mechanism, a fixing section, and a controller. The motor generates driving force. The image formation-transfer section state-changes between a first contact state and a first separate state by the driving force. The switching mechanism transmits and cuts off the driving force to the image formation-transfer section. The fixing section includes first and second rotating members, and state-changes between a second contact state and a second separate state by the driving force. The controller controls the motor and the switching mechanism and thereby causes part or all of a first period, in which the fixing section state-changes from the second separate state to the second contact state, and part or all of a second period, in which the image formation-transfer section state-changes from the first separate state to the first contact state, to overlap each other.

5 Claims, 16 Drawing Sheets

45

| OPERATION | SPEED |
|---|---|
| FIXING NIP | REVERSE-ROTATION SPEED V1 |
| FIXING WARM-UP | FORWARD-ROTATION SPEED V2 |
| ID CONTACT | REVERSE-ROTATION SPEED V3 |
| ID CONTACT AND FIXING NIP | REVERSE-ROTATION SPEED V1 |
| ID SEPARATION AND FIXING WARM-UP | FORWARD-ROTATION SPEED V2 |
| PRINTING | FORWARD-ROTATION SPEED VP |

FIG. 7

45R

| OPERATION | SPEED |
|---|---|
| FIXING NIP | REVERSE-ROTATION SPEED V1 |
| FIXING WARM-UP | FORWARD-ROTATION SPEED V2 |
| ID CONTACT | REVERSE-ROTATION SPEED V3 |
| ID CONTACT AND FIXING NIP | REVERSE-ROTATION SPEED V4 |
| ID SEPARATION AND FIXING WARM-UP | FORWARD-ROTATION SPEED V5 |
| PRINTING | FORWARD-ROTATION SPEED VP |

FIG. 19

IMAGE FORMING APPARATUS PERFORMING WARM-UP OPERATION BY ROTATION OF A MOTOR

CROSS REFERENCE TO RELATED APPLICATIONS

The present application claims priority from Japanese Patent Application No. 2019-180819 filed on Sep. 30, 2019, the entire contents of which are hereby incorporated by reference.

BACKGROUND

The technology relates to an image forming apparatus that controls contact operation and separate operation of an image forming section and forms an image on a medium.

In an image forming apparatus, for example, a toner image is formed in an image forming section, the formed toner image is transferred onto a medium, and the transferred toner image is fixed to the medium in a fixing section. For example, Japanese Unexamined Patent Application Publication No. 2007-057652 discloses an image forming apparatus that performs control of switching between contact operation and separate operation of a photosensitive drum and a belt of the image forming section.

SUMMARY

An image forming apparatus performs various types of operation, such as image forming operation, by rotation of a plurality of motors. In such a case, reduction in number of motors to be used allows for reduction in cost.

It is desirable to provide an image forming apparatus that makes it possible to suppress an increase in a required time for warm-up operation also in a case where number of motors is reduced.

According to one embodiment of the technology, there is provided an image forming apparatus that includes a motor, an image formation-transfer section, a switching mechanism, a fixing section, and a controller. The motor generates driving force. The image formation-transfer section includes an image carrier and a transfer section. The image formation-transfer section state-changes between a first contact state and a first separate state by the driving force generated by the motor. The first contact state is a state in which the image carrier and the transfer section are in contact with each other. The first separate state is a state in which the image carrier and the transfer section are separated away from each other. The image formation-transfer section forms a developer image on a medium or the transfer section in the first contact state. The switching mechanism transmits and cuts off the driving force to the image formation-transfer section. The fixing section includes a first rotating member and a second rotating member. The fixing section state-changes between a second contact state and a second separate state by the driving force generated by the motor. The second contact state is a state in which the first rotating member and the second rotating member are in contact with each other. The second separate state is a state in which the first rotating member and the second rotating member are separated away from each other. The fixing section performs fixing operation in the second contact state. The fixing operation is operation of fixing the developer image to the medium. The controller controls the motor and the switching mechanism and thereby causes part or all of a first period and part or all of a second period to overlap each other. The first period is a period in which the fixing section state-changes from the second separate state to the second contact state. The second period is a period in which the image formation-transfer section state-changes from the first separate state to the first contact state.

According to one embodiment of the technology, there is provided an image forming apparatus that includes a motor, an image formation-transfer section, a switching mechanism, a fixing section, and a controller. The motor generates driving force. The image formation-transfer section includes an image carrier and a transfer section. The image formation-transfer section state-changes between a first contact state and a first separate state by the driving force generated by the motor. The first contact state is a state in which the image carrier and the transfer section are in contact with each other. The first separate state is a state in which the image carrier and the transfer section are separated away from each other. The image formation-transfer section forms a developer image on a medium or the transfer section in the first contact state. The switching mechanism transmits and cuts off the driving force to the image formation-transfer section. The fixing section includes a first rotating member and a second rotating member. The fixing section state-changes between a second contact state and a second separate state by the driving force generated by the motor. The second contact state is a state in which the first rotating member and the second rotating member are in contact with each other. The second separate state is a state in which the first rotating member and the second rotating member are separated away from each other. The fixing section performs fixing operation in the second contact state. The fixing operation is operation of fixing the developer image to the medium. The controller controls the motor and the switching mechanism and thereby causes part or all of a third period and part or all of a fourth period to overlap each other. The third period is a period in which the fixing section performs warm-up operation in the second contact state. The fourth period is a period in which the image formation-transfer section state-changes from the first contact state to the first separate state.

According to one embodiment of the technology, there is provided an image forming apparatus that includes a motor, an image formation-transfer section, a switching mechanism, a fixing section, and a controller. The motor generates driving force. The image formation-transfer section includes an image carrier and a transfer section. The image formation-transfer section state-changes between a first state and a second state by the driving force generated by the motor. The first state is a state in which the image carrier and the transfer section are pressed against each other with pressure that is equal to or greater than first pressure. The second state includes a state in which the image carrier and the transfer section are pressed against each other with pressure that is smaller than the first pressure and a state in which the image carrier and the transfer section are separated away from each other. The image formation-transfer section forms a developer image on a medium or the transfer section in the first state. The switching mechanism transmits and cuts off the driving force to the image formation-transfer section. The fixing section includes a first rotating member and a second rotating member. The fixing section state-changes between a third state and a fourth state by the driving force generated by the motor. The third state is a state in which the first rotating member and the second rotating member are pressed against each other with pressure that is equal to or greater than second pressure. The fourth state includes a state in which the first rotating member and the second rotating member are pressed against each other with pressure that is smaller than the second pressure and a state in which the first rotating member and the second rotating member are separated away from each other. The fixing section performs fixing operation in the third state. The fixing operation is operation of fixing the developer image to the medium. The controller controls the motor and the switching mechanism and thereby causes part or all of a first period and part or all of a second period to overlap each other. The first period is a period in which the fixing section state-changes from the fourth state to the third state. The second period is a period in which the image formation-transfer section state-changes from the second state to the first state.

According to one embodiment of the technology, there is provided an image forming apparatus that includes a motor, an image formation-transfer section, a switching mechanism, a fixing section, and a controller. The motor generates driving force. The image formation-transfer section includes an image carrier and a transfer section. The image formation-transfer section state-changes between a first state and a second state by the driving force generated by the motor. The first state is a state in which the image carrier and the transfer section are pressed against each other with pressure that is equal to or greater than first pressure. The second state includes a state in which the image carrier and the transfer section are pressed against each other with pressure that is smaller than the first pressure and a state in which the image carrier and the transfer section are separated away from each other. The image formation-transfer section forms a developer image on a medium or the transfer section in the first state. The switching mechanism transmits and cuts off the driving force to the image formation-transfer section. The fixing section includes a first rotating member and a second rotating member. The fixing section state-changes between a third state and a fourth state by the driving force generated by the motor. The third state is a state in which the first rotating member and the second rotating member are pressed against each other with pressure that is equal to or greater than second pressure. The fourth state includes a state in which the first rotating member and the second rotating member are pressed against each other with pressure that is smaller than the second pressure and a state in which the first rotating member and the second rotating member are separated away from each other. The fixing section performs fixing operation in the third state. The fixing operation is operation of fixing the developer image to the medium. The controller controls the motor and the switching mechanism and thereby causes part or all of a third period and part or all of a fourth period to overlap each other. The third period is a period in which the fixing section performs warm-up operation in the third state. The fourth period is a period in which the image formation-transfer section state-changes from the first state to the second state.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the disclosure.

FIG. 7 is an explanatory diagram illustrating an example of a motor speed table illustrated in FIG. 6.

FIG. 19 is an explanatory diagram illustrating an example of a motor speed table according to a modification.

DETAILED DESCRIPTION

Figure 1:
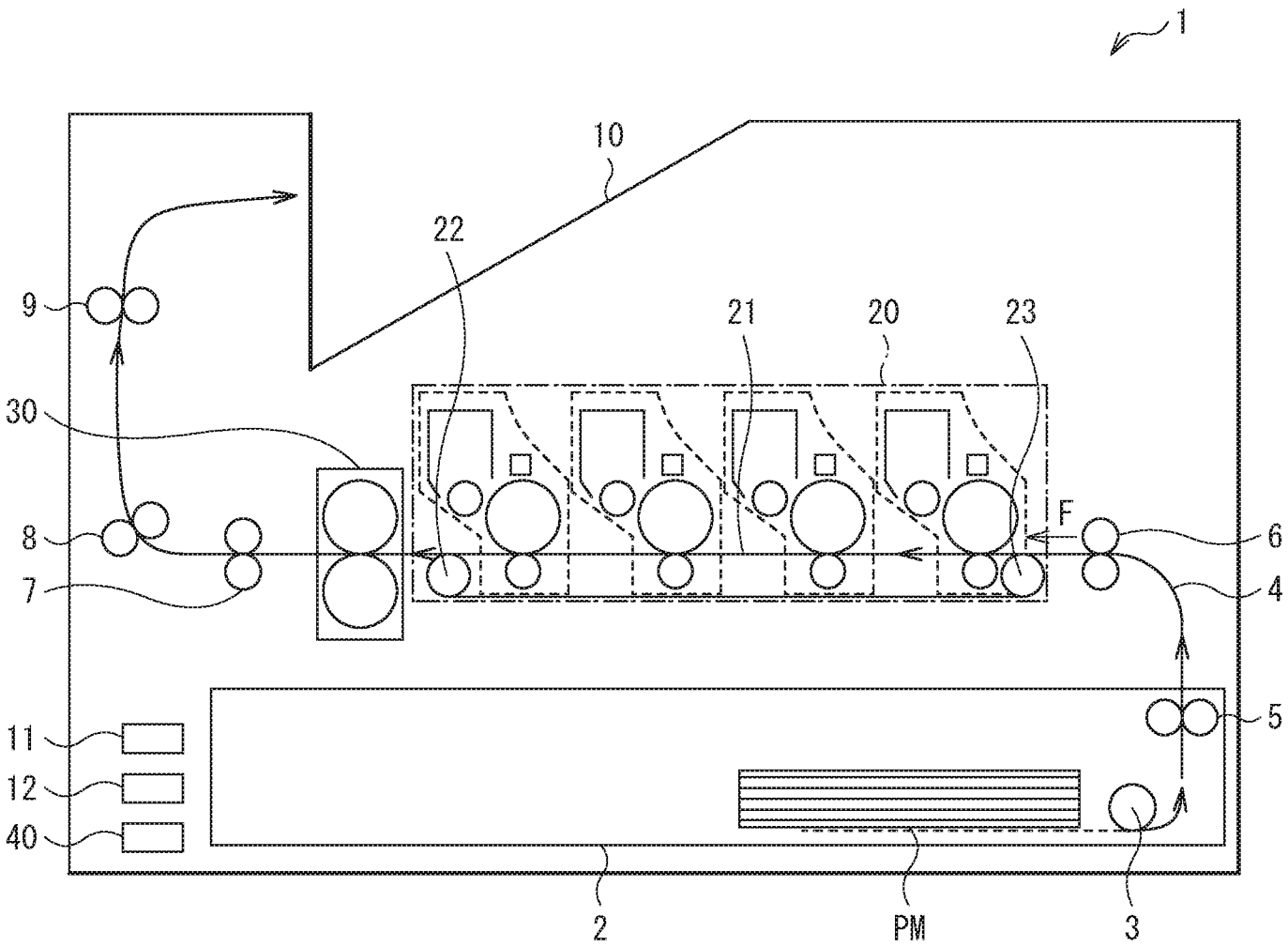
FIG. 1 is a configuration diagram illustrating an example of a configuration of an image forming apparatus according to one example embodiment.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. Example Embodiment
1.1 Configuration of Image Forming Apparatus
1.2 Operation of Image Forming Apparatus
(A) Basic Operation
(B) Detailed Operation of Warm-up Operation
1.3 Example Workings of Warm-up Operation
1.4 Example Effects
2. Modifications

1. Example Embodiment

[1.1 Configuration of Image Forming Apparatus 1]

FIG. 1 is a diagram illustrating an example of a configuration of an image forming apparatus 1 according to an example embodiment of the technology. The image forming apparatus 1 may be an electrophotographic printer, for example. The image forming apparatus 1 may perform image forming operation with use of a developer such as a toner, and thereby form a color image or a monochrome image on a medium PM such as paper. For example, the image forming apparatus 1 may perform communication with a host apparatus such as a personal computer, and thereby receive a print instruction. Herein, a term "upstream" refers to a position that is closer to a medium containing tray 2 described later as viewed from any position of interest on a conveying path along which the medium PM is conveyed, or a direction toward the medium containing tray 2. A term "downstream" refers to a position that is closer to a discharge tray 10 described later as viewed from any position of interest on the conveying path, or a direction toward the discharge tray 10. The discharge tray 10 may be a tray on which the discharged medium PM is placed. A direction from the upstream toward the downstream is referred to as a conveying direction F.

The image forming apparatus 1 may include, for example but not limited to, the medium containing tray 2, a pickup roller 3, paired conveying rollers 5, paired conveying rollers 6, an image formation-transfer section 20, a fixing section 30, paired conveying rollers 7, paired conveying rollers 8, and paired conveying rollers 9.

The medium containing tray 2 may be a container that contains the medium PM. The medium containing tray 2 may allow a plurality of recording media PM to be placed thereon. Provided downstream of the medium containing tray 2 may be the pickup roller 3.

The pickup roller 3 may be a rotating member that sends downstream the recording media PM placed on the medium containing tray 2 one by one. The pickup roller 3 may rotate with a central axis of the pickup roller 3 as a rotation axis on the basis of an instruction given from an apparatus controller 40 described later. Such rotation of the pickup roller 3 may be caused by driving force transmitted from an unillustrated pickup motor. The pickup roller 3 may convey the medium PM along a conveyance path 4. The conveyance path 4 may be a path along which the medium PM is conveyed from the upstream toward the downstream. Provided downstream of the pickup roller 3 may be the paired conveying rollers 5.

The paired conveying rollers 5 may convey the medium PM toward the paired conveying rollers 6 while sandwiching the medium PM. Upon conveying the medium PM, the paired conveying rollers 5 may correct a skew of the medium PM. To correct the skew of the medium PM, a leading-edge part of the medium PM may be abutted against parts, of the paired conveying rollers 5, that sandwich the medium PM. Provided downstream of the paired conveying rollers 5 may be the paired conveying rollers 6.

The paired conveying rollers 6 may convey the medium PM toward the image formation-transfer section 20 while sandwiching the medium PM. Provided downstream of the paired conveying rollers 6 may be the image formation-transfer section 20.

The image formation-transfer section 20 may be a mechanism that forms a toner image with use of a toner, transfers the formed toner image onto a transfer surface of the medium PM, and conveys the medium PM toward the fixing section 30, on the basis of an instruction given from the apparatus controller 40 described later. The image formation-transfer section 20 may include a belt 21, a driving roller 22, and an instruction roller 23. The belt 21 may be an endless member that conveys the medium PM along the conveyance path 4 in the conveying direction F. The driving roller 22 may be a rotating member that so rotates, on the basis of an instruction given from the apparatus controller 40 described later, as to convey the medium PM toward the fixing section 30 by driving force transmitted from an unillustrated belt motor. The driving roller 22 may thereby cause the belt 21 to circulate. The instruction roller 23 may be a member that adjusts tension applied to the belt 21 while stretching, in association with the driving roller 22, the belt 21 lying on the driving roller 22 and the instruction roller 23. The instruction roller 23 may rotate in substantially the same direction as the driving roller 22. Provided downstream of the image formation-transfer section 20 may be the fixing section 30.

The fixing section 30 may be a mechanism that performs, on the basis of an instruction given from the apparatus controller 40 described later, fixing operation, and thereby fixes the toner image to the medium PM. The fixing operation may involve applying heat and pressure to the toner image transferred onto the medium PM conveyed from the image formation-transfer section 20. Provided downstream of the fixing section 30 may be the paired conveying rollers 7.

The paired conveying rollers 7 may convey the medium PM toward the paired conveying rollers 8 while sandwiching the medium PM. Provided downstream of the paired conveying rollers 7 may be the paired conveying rollers 8.

The paired conveying rollers 8 may convey the medium PM toward the paired conveying rollers 9 while sandwiching the medium PM. Provided downstream of the paired conveying rollers 8 may be the paired conveying rollers 9.

The paired conveying rollers 9 may convey the medium PM toward the discharge tray 10 while sandwiching the medium PM. The discharge tray 10 may be a part on which the medium PM with the fixed toner image is to be placed.

[Image Formation-Transfer Section 20]

Figure 2:
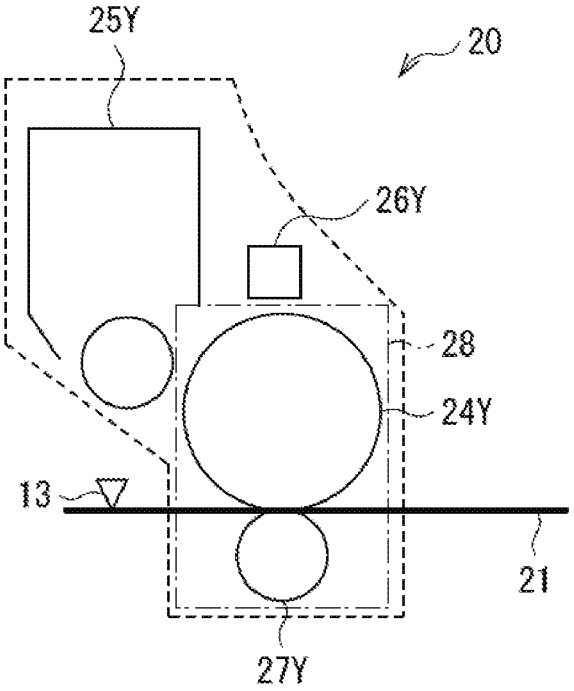
FIG. 2 is a configuration diagram illustrating an example of a configuration of part of an image formation-transfer section illustrated in FIG. 1.

FIG. 2 is a diagram illustrating an example of a configuration of part of the image formation-transfer section 20. The image formation-transfer section 20 may further include four photosensitive drums 24 (i.e., photosensitive drums 24Y, 24M, 24C, and 24K), four toner cartridges 25 (i.e., toner cartridges 25Y, 25M, 25C, and 25K), four light-emitting diode (LED) heads 26 (i.e., LED heads 26Y, 26M, 26C, and 26K), four transfer rollers 27 (i.e., transfer rollers 27Y, 27M, 27C, and 27K), a slider mechanism 28, and a slider-mechanism position sensor 13. FIG. 2 illustrates the photosensitive drum 24Y, the toner cartridge 25Y, the LED head 26Y, the transfer roller 27Y, the slider mechanism 28, and the slider-mechanism position sensor 13. In this example, the slider-mechanism position sensor 13 may be disposed in the vicinity of the photosensitive drum 24Y. A configuration of the photosensitive drum 24M, the toner cartridge 25M, the LED head 26M, the transfer roller 27M, the slider mechanism 28, and the slider-mechanism position sensor 13, a configuration of the photosensitive drum 24C, the toner cartridge 25C, the LED head 26C, the transfer roller 27C, the slider mechanism 28, and the slider-mechanism position sensor 13, and a configuration of the photosensitive drum 24K, the toner cartridge 25K, the LED head 26K, the transfer roller 27K, the slider mechanism 28, and the slider-mechanism position sensor 13 may be similar to the configuration illustrated in FIG. 2, and a description thereof is omitted where appropriate. The four photosensitive drums 24Y, 24M, 24C, and 24K may be disposed in this order from the downstream toward the upstream.

The photosensitive drum 24Y may have a surface (a surficial part) that carries an electrostatic latent image thereon. The photosensitive drum 24Y may rotate, on the basis of an instruction given from the apparatus controller 40 described later, by driving force transmitted from an unillustrated drum motor. The toner cartridge 25Y may contain a yellow toner. The toner cartridge 25M may contain a magenta toner. The toner cartridge 25C may contain a cyan toner. The toner cartridge 25K may contain a black toner. The LED head 26Y may apply light to the photosensitive drum 24Y on the basis of an instruction given from the apparatus controller 40 described later, whereby an electrostatic latent image may be formed on the surface of the photosensitive drum 24Y. Further, the toner may be fed from the toner cartridge 25Y, whereby a toner image based on the electrostatic latent image may be formed (i.e., developed) on the photosensitive drum 24Y. The transfer roller 27Y may transfer the toner image, which is formed on the surface of the photosensitive drum 24Y, onto the transfer surface of the medium PM or the belt 21 on the basis of an instruction given from the apparatus controller 40 described later.

The slider mechanism 28 may move the photosensitive drum 24Y, the photosensitive drum 24M, and the photosensitive drum 24C in a direction toward the belt 21 or a direction away from the belt 21 on the basis of an instruction given from the apparatus controller 40 described later. The slider mechanism 28 may thus move the photosensitive drum 24Y, the photosensitive drum 24M, and the photosensitive drum 24C by the driving force transmitted from a fixing motor 11 described later. In one specific but non-limiting example, the slider mechanism 28 may move the photosensitive drum 24Y, the photosensitive drum 24M, and the photosensitive drum 24C at substantially the same timing in the direction toward the belt 21 by the driving force transmitted from the fixing motor 11 described later that rotates in a reverse rotation direction. Further, the slider mechanism 28 may move the photosensitive drum 24Y, the photosensitive drum 24M, and the photosensitive drum 24C at substantially the same timing in the direction away from the belt 21 by the driving force transmitted from the fixing motor 11 described later that rotates in a forward rotation direction. In this example, the photosensitive drum 24K may be in contact with the transfer roller 27K with the belt 21 in between regardless of the operation of the slider mechanism 28. This may allow for state-changing between a drum contact state and a drum separate state. The term "state-change" and its variants used herein refer to change a state. The drum contact state may refer to a state in which the photosensitive drum 24Y, the photosensitive drum 24M, and the photosensitive drum 24C are pressed against the belt 21 with a pressing amount of a predetermined pressing amount or greater, causing the photosensitive drum 24Y, the photosensitive drum 24M, and the photosensitive drum 24C to be in contact with the belt 21. The drum separate state may refer to a state in which the photosensitive drum 24Y, the photosensitive drum 24M, and the photosensitive drum 24C are separated away from the belt 21. In the drum contact state, the photosensitive drum 24Y, the photosensitive drum 24M, and the photosensitive drum 24C may be pressed against the belt 21 with the pressing amount of the predetermined pressing amount or greater, and may be thus in contact with the transfer roller 27Y, the transfer roller 27M, and the transfer roller 27C, respectively, with the belt 21 in between. That is, the image formation-transfer section 20 may be configured to form yellow, magenta, cyan, and black toner images on the medium PM or the belt 21 in the drum contact state. In the drum separate state, the image formation-transfer section 20 may be configured to form a black toner image on the medium PM or the belt 21. In this example, the photosensitive drum 24Y, the photosensitive drum 24M, and the photosensitive drum 24C may be moved substantially at the same timing; however, this is non-limiting. In one example embodiment, the photosensitive drum 24Y, the photosensitive drum 24M, and the photosensitive drum 24C may be moved at different timings.

Figure 3:
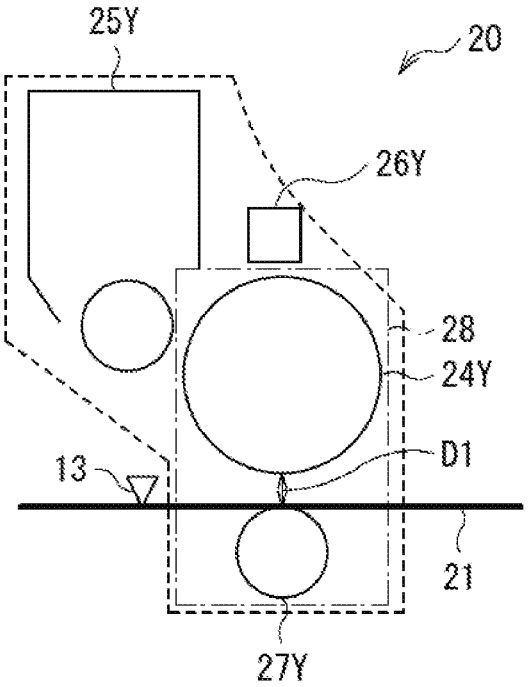
FIG. 3 is another configuration diagram illustrating an example of the configuration of the part of the image formation-transfer section illustrated in FIG. 1.

FIG. 3 is a diagram illustrating an example of a configuration of part of the image formation-transfer section 20 in the drum separate state. In this example, the slider mechanism 28 may move the photosensitive drum 24Y in the direction toward the belt 21 or the direction away from the belt 21, thereby varying a distance D1 that is from an outer peripheral surface of the photosensitive drum 24Y to the transfer surface of the belt 21. Here, the drum contact state may correspond to a state in which the distance D1 is 0 (zero) and the photosensitive drum 24Y, the photosensitive drum 24M, and the photosensitive drum 24C are pressed against the belt 21 with the pressing amount of the predetermined pressing amount or greater. In contrast, the drum separate state may correspond to: a state in which the distance D1 is 0 (zero) and the photosensitive drum 24Y, the photosensitive drum 24M, and the photosensitive drum 24C are pressed against the belt 21 with the pressing amount of less than the predetermined pressing amount; and a state in which the distance D1 is not 0 (zero).

The slider-mechanism position sensor 13 may detect the drum contact state and the drum separate state. In one specific but non-limiting example, the slider-mechanism position sensor 13 may detect whether each of the photosensitive drum 24Y, the photosensitive drum 24M, and the photosensitive drum 24C is in contact with the corresponding one of the transfer roller 27Y, the transfer roller 27M, and the transfer roller 27C with the belt 21 in between. Note that, in this example, the slider-mechanism position sensor 13 may detect the drum contact state and the drum separate state; however, this is non-limiting. In one example embodiment, the slider-mechanism position sensor 13 may detect the distance D1.

[Fixing Section 30]

Figure 4:
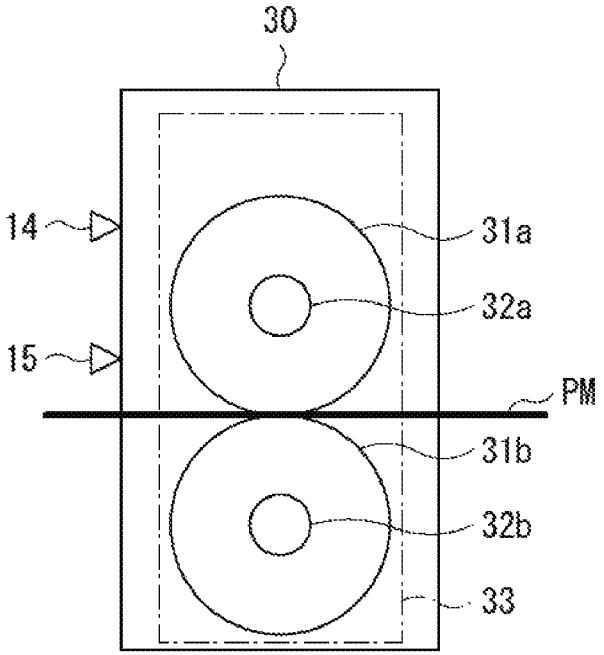
FIG. 4 is a configuration diagram illustrating an example of a configuration of a fixing section illustrated in FIG. 1.

FIG. 4 is a diagram illustrating an example of a configuration of the fixing section 30. The fixing section 30 may include an upper fixing roller 31*a*, a lower fixing roller 31*b*, a roller separating mechanism 33, a temperature sensor 14, and a fixing-roller position sensor 15. The upper fixing roller 31*a* may apply heat to the toner on the medium PM. The upper fixing roller 31*a* may rotate, on the basis of an instruction given from the apparatus controller 40 described later, by driving force transmitted from the fixing motor 11 described later. The upper fixing roller 31*a* may include a heater 32*a*. The heater 32*a* may heat the upper fixing roller 31*a* on the basis of an instruction given from a fixing-section temperature control section 42 described later. The heater 32*a* may include, for example but not limited to, a halogen heater or a ceramic heater. The lower fixing roller 31*b* may apply heat to the toner on the medium PM. The lower fixing roller 31*b* may rotate along with the upper fixing roller 31*a*. That is, the upper fixing roller 31*a* may serve as a driving roller and the lower fixing roller 31*b* may serve as a driven roller. The lower fixing roller 31*b* may include a heater 32*b*. The heater 32*b* may heat the lower fixing roller 31*b* on the basis of an instruction given from the fixing-section temperature control section 42 described later, as with the upper fixing roller 31*a*.

The roller separating mechanism 33 may move the upper fixing roller 31*a* in a direction toward the lower fixing roller 31*b* or a direction away from the lower fixing roller 31*b* on the basis of an instruction given from the apparatus controller 40 described later. The roller separating mechanism 33 may thus move the upper fixing roller 31*a* by driving force transmitted from the fixing motor 11 described later that rotates in the reverse rotation direction. In one specific but non-limiting example, the roller separating mechanism 33 may include a camshaft that is in contact with the upper fixing roller 31*a*. The camshaft may press the upper fixing roller 31*a* against the lower fixing roller 31*b*. Thus, in the roller separating mechanism 33, the upper fixing roller 31*a* may be pressed against the lower fixing roller 31*b* with a pressing amount of a predetermined pressing amount or greater in a predetermined rotation angle range of single rotation of the camshaft, causing the upper fixing roller 31*a* and the lower fixing roller 31*b* to be in contact with each other. This may allow for state-changing between a roller contact state and a roller separate state. The roller contact state may refer to a state in which the upper fixing roller 31*a* is pressed against the lower fixing roller 31*b* with the pressing amount of the predetermined pressing amount or greater, causing the upper fixing roller 31*a* to be in contact with the lower fixing roller 31*b*. The roller separate state may refer to a state in which the upper fixing roller 31*a* is separated away from the lower fixing roller 31*b*. That is, in a case where the fixing motor 11 continues to rotate in substantially the same direction, the upper fixing roller 31*a* and the lower fixing roller 31*b* may be repeatedly caused to be in the roller contact state and the roller separate state alternately. In the roller contact state, a contact part may be provided between the upper fixing roller 31*a* and the lower fixing roller 31*b*. Therefore, upon conveying the medium PM, the upper fixing roller 31*a* and the lower fixing roller 31*b* may apply pressure to the toner on the medium PM. The fixing section 30 may be configured to thus perform the operation of fixing the toner image to the medium PM in the roller contact state.

Figure 5:
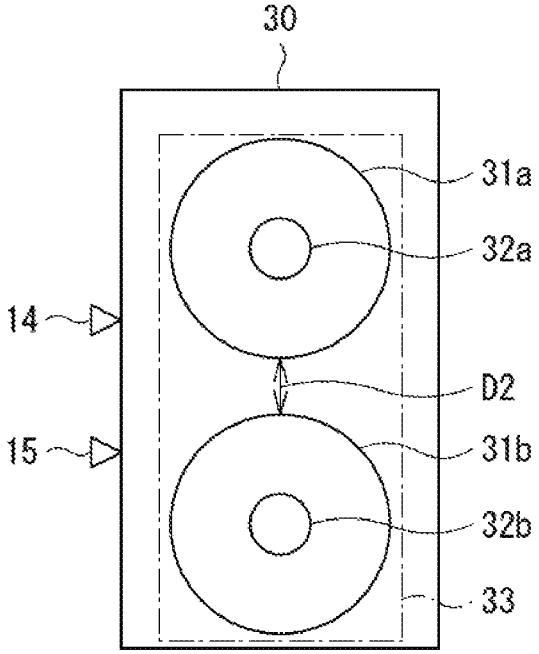
FIG. 5 is another configuration diagram illustrating an example of the configuration of the fixing section illustrated in FIG. 1.

FIG. 5 is a diagram illustrating an example of the configuration of the fixing section 30 in the roller separate state. In this example, the roller separating mechanism 33 may move the upper fixing roller 31*a* in the direction toward the lower fixing roller 31*b* or the direction away from the lower fixing roller 31*b*, thereby varying a distance D2 that is from an outer peripheral surface of the upper fixing roller 31*a* to an outer peripheral surface of the lower fixing roller 31*b*. Here, the roller contact state may correspond to a state in which the distance D2 is 0 (zero) and the upper fixing roller 31*a* is pressed against the lower fixing roller 31*b* with the pressing amount of the predetermined pressing amount or greater. In contrast, the roller separate state may correspond to: a state in which the distance D2 is 0 (zero) and the upper fixing roller 31*a* is pressed against the lower fixing roller 31*b* with a pressing amount of less than the predetermined pressing amount; and a state in which the distance D2 is not 0 (zero).

The temperature sensor 14 may include a thermistor, for example. The temperature sensor 14 may detect a temperature of the fixing section 30.

The fixing-roller position sensor 15 may detect the roller contact state and the roller separate state. In one specific but non-limiting example, the fixing-roller position sensor 15 may detect whether the upper fixing roller 31*a* is in contact with the lower fixing roller 31*b*. Note that, in this example, the fixing-roller position sensor 15 may detect the roller contact state and the roller separate state; however, this is non-limiting. In one example embodiment, the fixing-roller position sensor 15 may detect the distance D2.

The image forming apparatus 1 may further include the fixing motor 11, a clutch 12, and the apparatus controller 40.

The fixing motor 11 may rotate, on the basis of an instruction given from a motor control section 44 described later, and thereby generate driving force. The fixing motor 11 may transmit the generated driving force to the upper fixing roller 31*a* and the roller separating mechanism 33, and also transmit the generated driving force to the slider mechanism 28 via the clutch 12. In one specific but non-limiting example, the fixing motor 11 may rotate in the forward rotation direction, thereby generate driving force, and transmit the generated driving force to the upper fixing roller 31*a*. The upper fixing roller 31*a* and the lower fixing roller 31*b* may each rotate in the direction of conveying the medium PM away from the image formation-transfer section 20 in the roller contact state. In other words, the rotation of the fixing motor 11 in the forward rotation direction may cause the fixing section 30 to perform the fixing operation while conveying the medium PM in the roller contact state, or may cause the fixing section 30 to perform fixing warm-up operation in the roller contact state. Here, the fixing warm-up operation may refer to operation in which the upper fixing roller 31*a* and the lower fixing roller 31*b* each rotate in the roller contact state with a temperature of the fixing section 30 being adjusted, which will be described later. The fixing warm-up operation may cause a temperature of a surface of the upper fixing roller 31*a* and a temperature of a surface of the lower fixing roller 31*b* to be substantially uniform. In contrast, the fixing motor 11 may rotate in the reverse rotation direction, thereby generate driving force, and transmit the generated driving force to the roller separating mechanism 33. As illustrated in FIGS. 4 and 5, the upper fixing roller 31*a* and the lower fixing roller 31*b* may be repeatedly caused to be in the roller contact state and the roller separate state alternately. The fixing section 30 may thereby perform fixing nip operation. The fixing nip operation may refer to operation in which the upper fixing roller 31*a* and the lower fixing roller 31*b* state-change from the roller separate state to the roller contact state. Further, the fixing motor 11 may rotate in the forward rotation direction, thereby generate driving force, and transmit the generated driving force to the slider mechanism 28. As illustrated in FIGS. 2 and 3, the image formation-transfer section 20 may perform ID separation operation. The ID separation operation may refer to operation in which the belt 21 and the photosensitive drums 24Y, 24M, and 24C state-change from the drum contact state to the drum separate state. In contrast, the fixing motor 11 may rotate in the reverse rotation direction, thereby generate driving force, and transmit the generated driving force to the slider mechanism 28. As illustrated in FIGS. 2 and 3, the image formation-transfer section 20 may perform ID contact operation. The ID contact operation may refer to operation in which the belt 21 and the photosensitive drums 24Y, 24M, and 24C state-change from the drum separate state to the drum contact state.

The clutch 12 may transmit and cut off the driving force of the fixing motor 11 to the image formation-transfer section 20 on the basis of an instruction given from the motor control section 44 described later. In one specific but non-limiting example, the clutch 12 may transmit the driving force of the fixing motor 11 to the slider mechanism 28 in a case where the image forming apparatus 1 performs the ID contact operation. The clutch 12 may cut off the driving force of the fixing motor 11 to the slider mechanism 28 in a case where the image forming apparatus 1 does not perform the ID contact operation. Further, the clutch 12 may transmit the driving force of the fixing motor 11 to the slider mechanism 28 in a case where the image forming apparatus 1 performs the ID separation operation. The clutch 12 may cut off the driving force of the fixing motor 11 to the slider mechanism 28 in a case where the image forming apparatus 1 does not perform the ID separation operation.

The apparatus controller 40 may control various types of operation in the image forming apparatus 1 on the basis of the received print instruction, a detection result obtained by the slider-mechanism position sensor 13, a detection result obtained by the temperature sensor 14, and a detection result obtained by the fixing-roller position sensor 15. In one specific but non-limiting example, the apparatus controller 40 may control various types of operation in the image formation-transfer section 20. Further, the apparatus controller 40 may control various types of operation in the fixing section 30. The apparatus controller 40 may include, for example but not limited to, a program-executable processor and a random-access memory (RAM). Operation of the apparatus controller 40 may be achieved by hardware or software, for example.

[Control System of Image Forming Apparatus 1]

Figure 6:
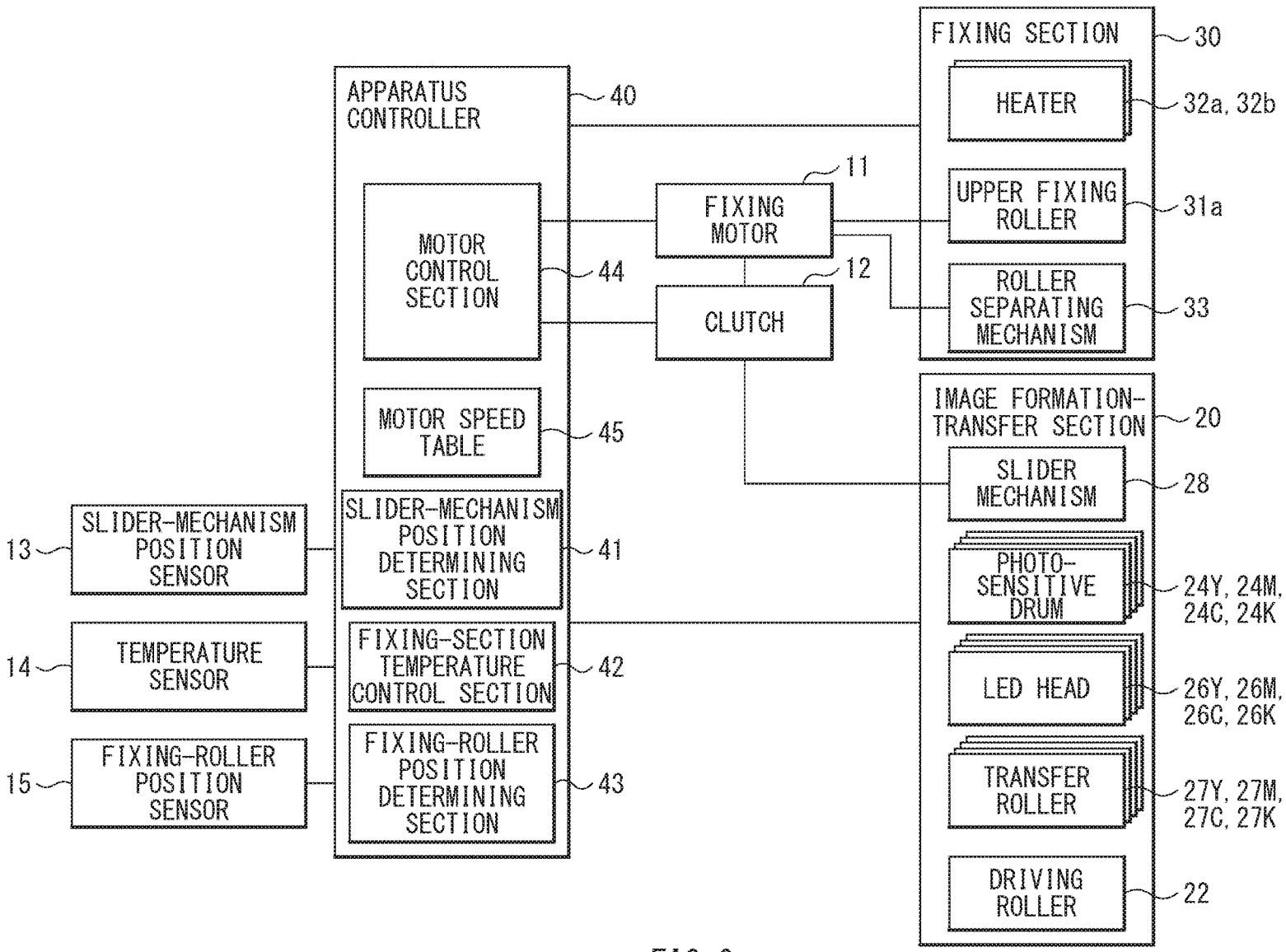
FIG. 6 is a block diagram illustrating an example of a control system of an image forming apparatus illustrated in FIG. 1.

FIG. 6 is a block diagram illustrating an example of a control system of the image forming apparatus 1. The apparatus controller 40 may include a slider-mechanism position determining section 41, the fixing-section temperature control section 42, a fixing-roller position determining section 43, the motor control section 44, and a motor speed table 45.

The slider-mechanism position determining section 41 may determine, on the basis of, the detection result obtained by the slider-mechanism position sensor 13, whether the image formation-transfer section 20 is to complete the ID contact operation or the ID separation operation. In one specific but non-limiting example, the slider-mechanism position determining section 41 may determine which of the drum contact state and the drum separate state the image formation-transfer section 20 is in, and thereby determine whether the image formation-transfer section 20 is to complete the ID contact operation or the ID separation operation.

The fixing-section temperature control section 42 may control the heater 32*a* and the heater 32*b* of the fixing section 30 on the basis of the detection result obtained by the temperature sensor 14. In one specific but non-limiting example, the fixing-section temperature control section 42 may so control the heater 32*a* and the heater 32*b* that the heater 32*a* and the heater 32*b* perform temperature adjustment operation immediately before the fixing warm-up operation. The temperature adjustment operation may refer to operation of adjusting the temperature of the upper fixing roller 31*a* and the temperature of the lower fixing roller 31*b*. Further, upon the fixing warm-up operation, the fixing-section temperature control section 42 may so control the heater 32*a* and the heater 32*b* that the temperature of the upper fixing roller 31*a* and the temperature of the lower fixing roller 31*b* are adjusted. Further, upon the fixing operation, the fixing-section temperature control section 42 may so control the heater 32*a* and the heater 32*b* that the temperature of the upper fixing roller 31*a* and the temperature of the lower fixing roller 31*b* are adjusted.

The fixing-roller position determining section 43 may determine, on the basis of the detection result obtained by the fixing-roller position sensor 15, whether the fixing section 30 is to complete the fixing nip operation. In one specific but non-limiting example, the fixing-roller position determining section 43 may determine which of the roller contact state and the roller separate state the fixing section 30 is in, and thereby determine whether the fixing section 30 is to complete the fixing nip operation.

The motor control section 44 may control the fixing motor 11 and the clutch 12 on the basis of the received print instruction, a determination result obtained by the slider-mechanism position determining section 41, an instruction given from the fixing-section temperature control section 42, and a determination result obtained by the fixing-roller position determining section 43. In one specific but non-limiting example, the motor control section 44 may so control the fixing motor 11 and the clutch 12 that part or all of a period in which the fixing section 30 state-changes from the roller separate state to the roller contact state and part or all of a period in which the image formation-transfer section 20 state-changes from the drum separate state to the drum contact state overlap each other. Further, the motor control section 44 may so control the fixing motor 11 and the clutch 12 that part or all of a period in which the fixing section 30 performs the fixing warm-up operation in the roller contact state and part or all of a period in which the image formation-transfer section 20 state-changes from the drum contact state to the drum separate state overlap each other.

The motor speed table 45 may include speed data associated with various types of operation. The speed data may represent a rotation direction and a rotation speed of the fixing motor 11.

FIG. 7 is an explanatory diagram illustrating an example of the motor speed table 45. In a case where the image forming apparatus 1 performs the fixing nip operation, the speed of the fixing motor 11 may be set to a reverse-rotation speed V1. In a case where the image forming apparatus 1 performs the fixing warm-up operation, the speed of the fixing motor 11 may be set to a forward-rotation speed V2. In a case where the image forming apparatus 1 performs the ID contact operation, the speed of the fixing motor 11 may be set to a reverse-rotation speed V3. Note that the reverse-rotation speed V3 may not be used in this example. In a case where the image forming apparatus 1 performs the ID contact operation and the fixing nip operation together, the speed of the fixing motor 11 may be set to the reverse-rotation speed V1. In a case where the image forming apparatus 1 performs the ID separation operation and the fixing warm-up operation together, the speed of the fixing motor 11 may be set to the forward-rotation speed V2. In a case where the image forming apparatus 1 performs the fixing operation in printing, the speed of the fixing motor 11 may be set to a forward-rotation speed VP. The printing may involve: forming an image on the conveyed medium PM; and discharging the medium PM with the formed image. In this example, the fixing nip operation may be allowed in a case where the driving force of the fixing motor 11 is equal to or greater than driving force to be generated by rotation of the fixing motor 11 at the reverse-rotation speed V1. That is, in a case where the speed of the fixing motor 11 exceeds the reverse-rotation speed V1, for example, torque to be generated by the fixing motor 11 may be reduced. This may cause insufficiency of the driving force for the fixing nip operation, making it difficult to perform the fixing nip operation. The ID contact operation may be allowed in a case where the driving force of the fixing motor 11 is equal to or greater than driving force to be generated by rotation of the fixing motor 11 at the reverse-rotation speed V3. That is, in a case where the speed of the fixing motor 11 exceeds the reverse-rotation speed V3, for example, torque to be generated by the fixing motor 11 may be reduced. This may cause insufficiency of the driving force for the ID contact operation, making it difficult to perform the ID contact operation. In this example, the reverse-rotation speed V1 may be lower than the reverse-rotation speed V3. Therefore, each of the fixing nip operation and the ID contact operation may be allowed by the rotation of the fixing motor 11 at the reverse-rotation speed V1. The fixing warm-up operation may be allowed in a case where the driving force of the fixing motor 11 is equal to or greater than driving force to be generated by rotation of the fixing motor 11 at the forward-rotation speed V2. The ID contact operation may be allowed in a case where the driving force of the fixing motor 11 is equal to or greater than driving force to be generated by rotation of the fixing motor 11 at the forward-rotation speed V2. In this example, each of the fixing warm-up operation and the ID separation operation may be allowed by the rotation of the fixing motor 11 at the forward-rotation speed V2.

The fixing motor 11 may correspond to a "motor" in one specific but non-limiting embodiment of the technology. The photosensitive drums 24Y, 24M, and 24C may correspond to an "image carrier" in one specific but non-limiting embodiment of the technology. The belt 21 may correspond to a "transfer section" in one specific but non-limiting embodiment of the technology. The image formation-transfer section 20 may correspond to an "image formation-transfer section" in one specific but non-limiting embodiment of the technology. The clutch 12 may correspond to a "switching mechanism" in one specific but non-limiting embodiment of the technology. The upper fixing roller 31*a* may correspond to a "first rotating member" in one specific but non-limiting embodiment of the technology. The lower fixing roller 31*b* may correspond to a "second rotating member" in one specific but non-limiting embodiment of the technology. The fixing section 30 may correspond to a "fixing section" in one specific but non-limiting embodiment of the technology. The motor control section 44 may correspond to a "controller" in one specific but non-limiting embodiment of the technology.

[1.2 Operation of Image Forming Apparatus 1]

[A. Basic Operation]

In a case where the image forming apparatus 1 forms a color image on, for example, the medium PM, the image forming apparatus 1 may perform warm-up operation. The warm-up operation may be pre-printing preparation operation of the image forming apparatus 1, and may include pre-printing preparation operation in the image formation-transfer section 20 and pre-printing preparation operation in the fixing section 30. After the warm-up operation, the image formation-transfer section 20 may be in the drum contact state and the fixing section 30 may be in the roller contact state. Further, the image forming apparatus 1 may perform printing as follows.

Operation of the image forming apparatus 1 in printing is described with reference to FIGS. 1 and 6. First, the apparatus controller 40 may control operation of the pickup roller 3, the paired conveying rollers 5, and the paired conveying rollers 6. This may cause the medium PM to be conveyed along the conveyance path 4 toward the image formation-transfer section 20.

Further, the apparatus controller 40 may so control the image formation-transfer section 20 that the image formation-transfer section 20 forms a toner image on the photosensitive drum 24 with use of the toner, transfers the formed toner image onto the transfer surface of the medium PM, and conveys the medium PM toward the fixing section 30. On this occasion, the apparatus controller 40 may so control the photosensitive drum 24 that the photosensitive drum 24 rotates, and may so control the LED head 26 that the LED head 26 applies light to the photosensitive drum 24. This may form an electrostatic latent image on the surface of the photosensitive drum 24 of the image formation-transfer section 20, and may form a toner image on the basis of the electrostatic latent image. Further, the apparatus controller 40 may so control the transfer roller 27 that the toner image formed on the surface of the photosensitive drum 24 is transferred onto the transfer surface of the medium PM. This may transfer the toner image onto the transfer surface of the medium PM. The apparatus controller 40 may so control the driving roller 22 that the driving roller 22 conveys the medium PM toward the fixing section 30, thereby causing the belt 21 to circulate. This may convey the medium PM along the conveyance path 4 toward the fixing section 30.

The apparatus controller 40 may so control the fixing section 30 that the fixing section 30 performs the fixing operation. On this occasion, the fixing-section temperature control section 42 may so control, on the basis of the detection result obtained by the temperature sensor 14, the heater 32*a* and the heater 32*b* that the temperature of the upper fixing roller 31*a* and the temperature of the lower fixing roller 31*b* are adjusted. Further, the motor control section 44 may so control the fixing motor 11 that the fixing section 30 performs the fixing operation while conveying the medium PM in the roller contact state. Accordingly, in the fixing section 30, the toner on the medium PM may be heated, melted, and applied with pressure. As a result, the toner image may be fixed to the medium PM.

Thereafter, the apparatus controller 40 may control operation of the paired conveying rollers 7, the paired conveying rollers 8, and the paired conveying rollers 9. This may discharge the medium PM with the fixed toner image to the discharge tray 10.

The operation of the image forming apparatus 1 in the printing may be as described above. In a case where the image forming apparatus 1 forms a monochrome image, for example, on the medium PM, the image formation-transfer section 20 may be in the drum separate state and the fixing section 30 may be in the roller contact state, after the warm-up operation is performed. Further, the image forming apparatus 1 may perform the printing in a manner similar to that in the case of forming the color image on the medium PM.

[B. Detailed Operation of Warm-Up Operation]

The warm-up operation of the image forming apparatus 1 is described in detail below. Note that the warm-up operation may be stopped, for example, in a case where an abnormality such as a malfunction of the fixing motor 11 or a temperature abnormality of any of the heaters 32*a* and 32*b* is detected during the warm-up operation.

[Warm-Up Operation Including ID Contact Operation]

In the warm-up operation, for example, in a case where the image forming apparatus 1 forms a monochrome image and thereafter forms a color image, the ID contact operation may be performed as the pre-printing preparation operation in the image formation-transfer section 20, and the fixing nip operation and the fixing warm-up operation may be performed as the pre-printing preparation operation in the fixing section 30. The apparatus controller 40 may start the warm-up operation in response to reception of a print instruction. This operation is described in detail below.

Figure 8:
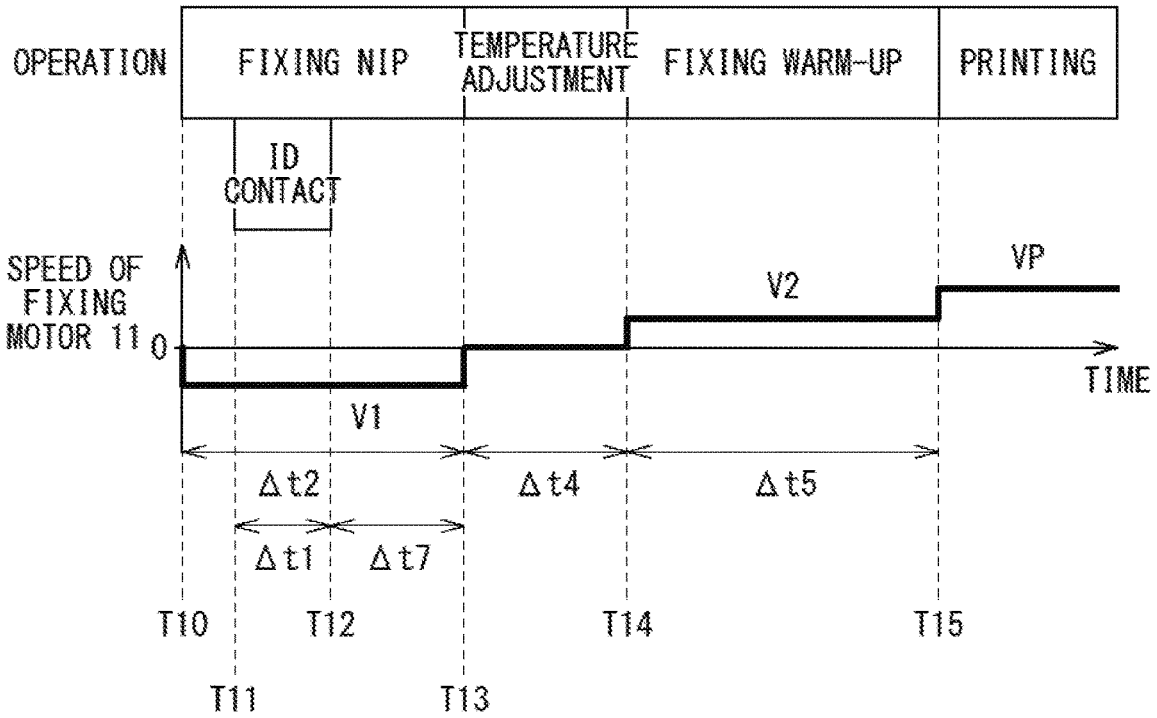
FIG. 8 is a sequence diagram illustrating an example of warm-up operation of the image forming apparatus illustrated in FIG. 1.

FIG. 8 illustrates an example of a sequence of the warm-up operation in a case where the image forming apparatus 1 performs the ID contact operation after the fixing nip operation is started. In this example, the image forming apparatus 1 may start the fixing nip operation at a timing T10, and complete the fixing nip operation at a timing T13. A time Δt2 may be a required time for the fixing nip operation. The time Δt2 may be from the timing T10 to the timing T13 in this example. In one specific but non-limiting example, the time Δt2 may be a total time of: a time from a timing when the image forming apparatus 1 starts state-changing to the roller contact state to a timing when the fixing-roller position sensor 15 detects the roller contact state; and a time from a timing when the image forming apparatus 1 starts state-changing from the roller contact state to the roller separate state to a timing when the image forming apparatus 1 returns to the roller contact state again. Here, because the distance D2 in the roller separate state is indefinite at a start timing of the warm-up operation, the time Δt2 may be indefinite. Upon the fixing nip operation, the fixing motor 11 may rotate at the reverse-rotation speed V1. The image forming apparatus 1 may start the ID contact operation at a timing T11 after the timing T10, and complete the ID contact operation at a timing T12 before the timing T13. A time Δt1 may be a required time for the ID contact operation. The time Δt1 may be from the timing T11 to the timing T12 in this example. Because the distance D1 in the drum separate state may have a fixed value at the start timing of the warm-up operation, the time Δt1 may be constant. In this example, the time Δt1 may be shorter than the time from the timing when the image forming apparatus 1 starts state-changing from the roller contact state to the roller separate state to the timing when the image forming apparatus 1 returns to the roller contact state again. A time Δt7 may be a required time for adjustment operation, of the fixing nip operation, that is to be performed after the ID contact operation. The time Δt7 may be from the timing T12 to the timing T13 in this example. The image forming apparatus 1 may perform the ID contact operation together with the fixing nip operation. Therefore, in a period in which the ID contact operation is being performed, the distance D2 in the roller separate state may vary, making it difficult to complete the fixing nip operation. That is, it may be necessary for the image forming apparatus 1 to state-change from the roller separate state to the roller contact state at least once in the time Δt7. Because the distance D2 in the roller separate state is indefinite at a completion timing of the ID contact operation, the time Δt7 may be indefinite. The image forming apparatus 1 may start the temperature adjustment operation at the timing T13, and complete the temperature adjustment operation at a timing T14. A time Δt4 may be a required time for the temperature adjustment operation. The time Δt4 may be from the timing T13 to the timing T14 in this example. The fixing motor 11 may be stopped upon the temperature adjustment operation. The image forming apparatus 1 may start the fixing warm-up operation at the timing T14, and complete the fixing warm-up operation at a timing T15. A time Δt5 may be from the timing T14 to the timing T15 in this example. Upon the fixing warm-up operation, the fixing motor 11 may rotate at the forward-rotation speed V2. Thereafter, the image forming apparatus 1 may start printing at the timing T15. At and after the timing T15, the fixing motor 11 may rotate at the forward-rotation speed VP.

Figure 9:
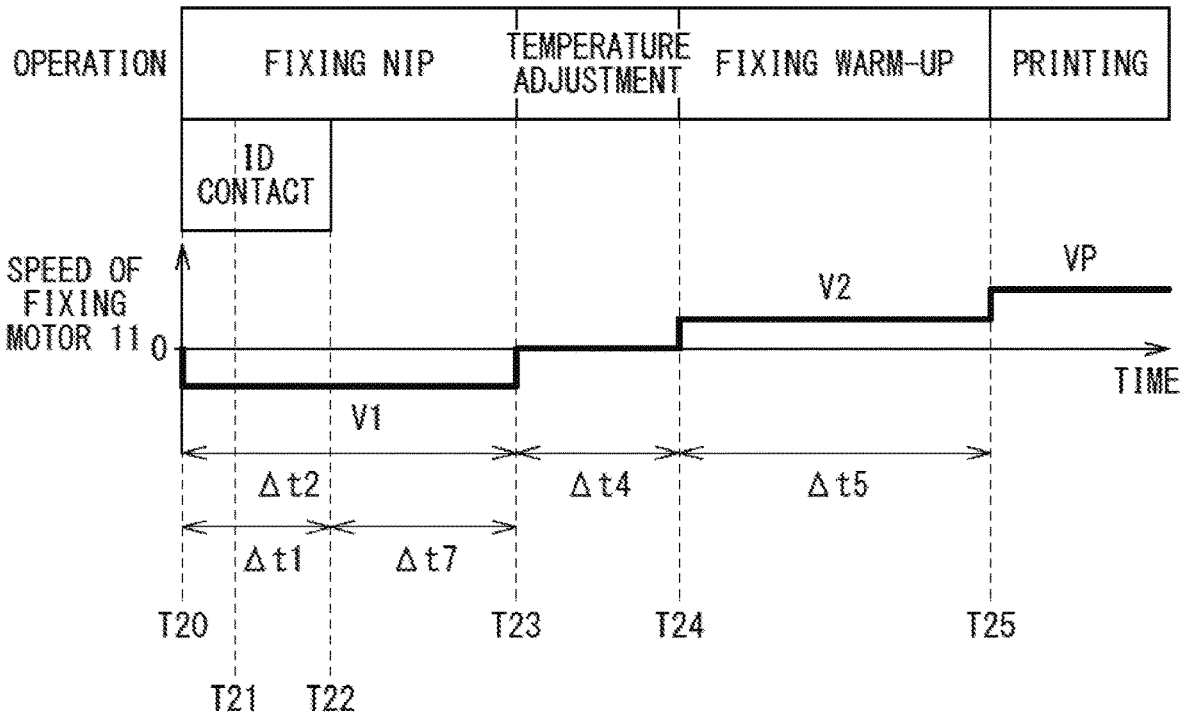
FIG. 9 is another sequence diagram illustrating an example of the warm-up operation of the image forming apparatus illustrated in FIG. 1.

FIG. 9 illustrates an example of a sequence of the warm-up operation in a case where the image forming apparatus 1 starts the ID contact operation together with the fixing nip operation. In this example, the image forming apparatus 1 may start the fixing nip operation at a timing T20, and complete the fixing nip operation at a timing T23. The time Δt2 may be from the timing T20 to the timing T23 in this example. Upon the fixing nip operation, the fixing motor 11 may rotate at the reverse-rotation speed V1. The image forming apparatus 1 may start the ID contact operation at the timing T20, and complete the ID contact operation at a timing T22 before the timing T23. The time Δt1 may be from the timing T20 to the timing T22 in this example. The time Δt7 may be from the timing T22 to the timing T23 in this example. Here, the timing T21 may be a provisional start timing of the fixing nip operation that is estimated at the start timing of the warm-up operation, which will be described in detail later. The image forming apparatus 1 may start the temperature adjustment operation at the timing T23, and complete the temperature adjustment operation at a timing T24. The time Δt4 may be from the timing T23 to the timing T24 in this example. The fixing motor 11 may be stopped upon the temperature adjustment operation. The image forming apparatus 1 may start the fixing warm-up operation at the timing T24, and complete the fixing warm-up operation at a timing T25. The time Δt5 may be from the timing T24 to the timing T25 in this example. Upon the fixing warm-up operation, the fixing motor 11 may rotate at the forward-rotation speed V2. Thereafter, the image forming apparatus 1 may start printing at the timing T25. At and after the timing T25, the fixing motor 11 may rotate at the forward-rotation speed VP.

Figure 10A:
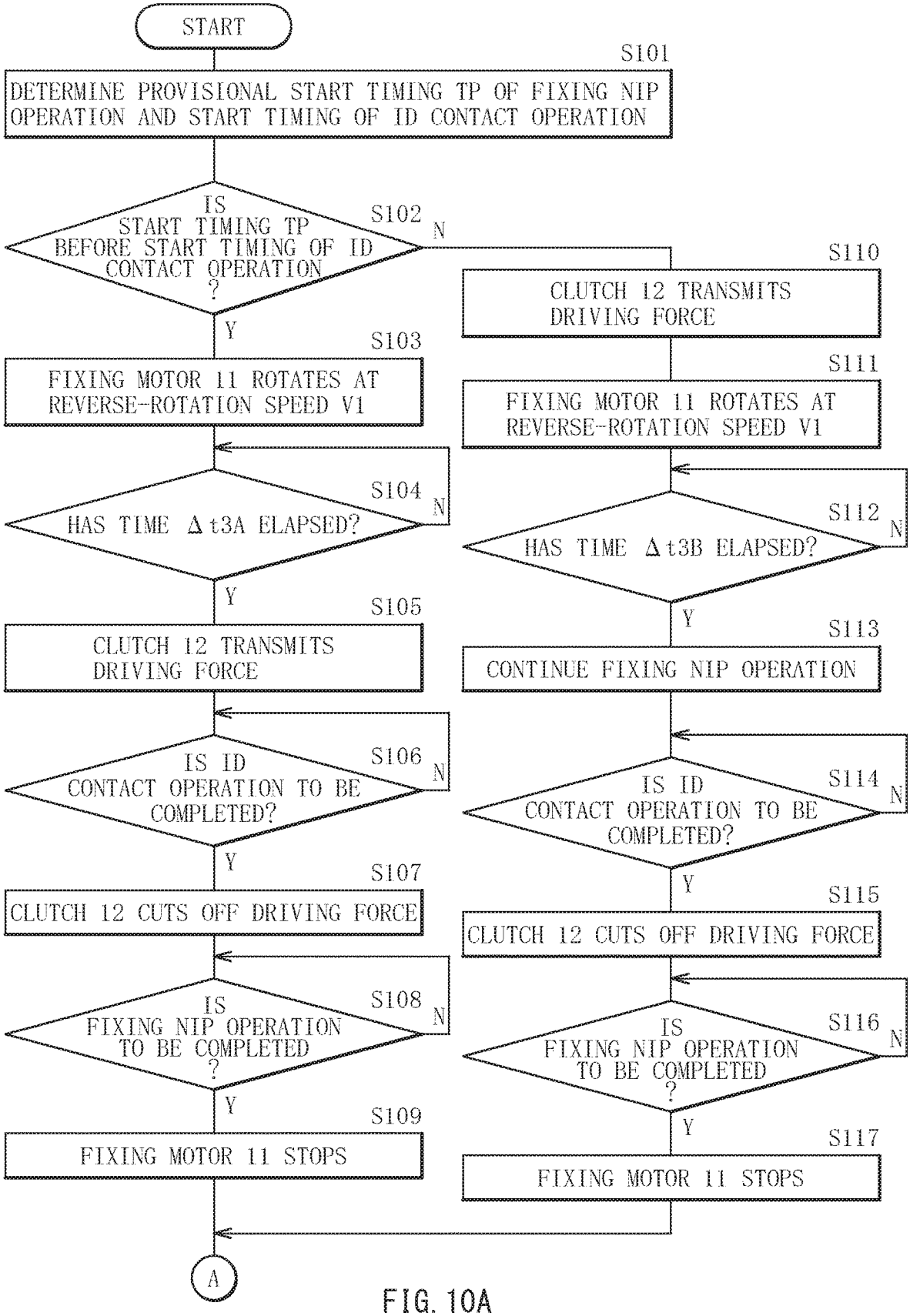
FIG. 10A is a flowchart illustrating an example of the warm-up operation of the image forming apparatus illustrated in FIG. 1.
Figure 10B:
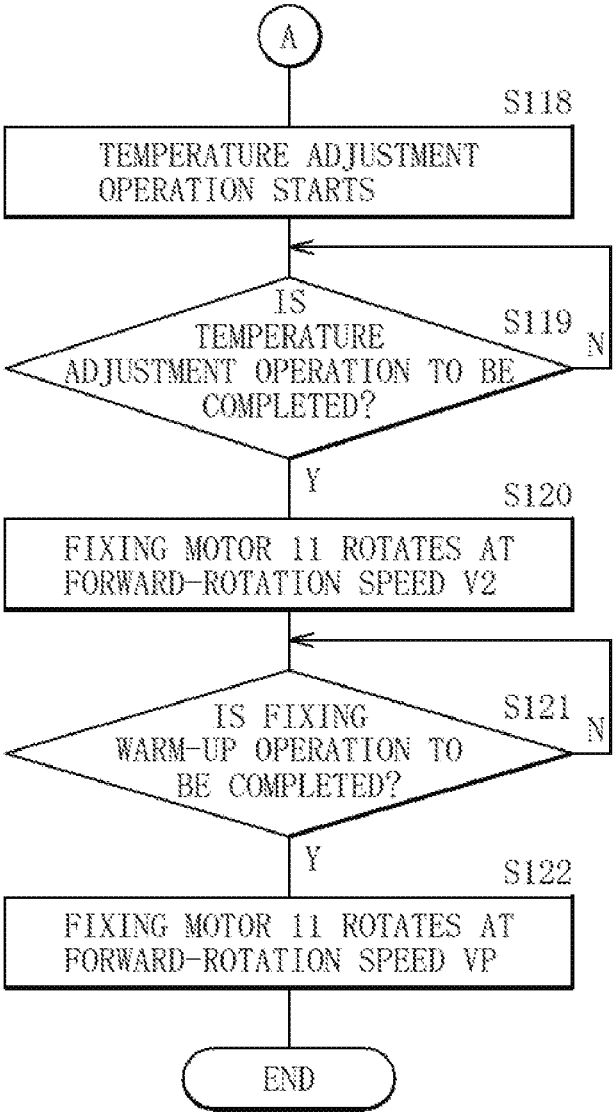
FIG. 10B is another flowchart illustrating the example of the warm-up operation of the image forming apparatus illustrated in FIG. 1.

FIGS. 10A and 10B illustrate an example of processes of the warm-up operation including the ID contact operation. First, the motor control section 44 may determine the provisional start timing TP of the fixing nip operation and the start timing of the ID contact operation on the basis of the received print instruction (step S101). In one specific but non-limiting example, the motor control section 44 may estimate a time Δt2P and a time Δt7P. The time Δt2P may be a provisional required time for the fixing nip operation. The time Δt7P may be a provisional required time for the adjustment operation of the fixing nip operation. For example, the motor control section 44 may estimate, as the time Δt2P, a total time of: a time from a timing where the image forming apparatus 1 starts state-changing from the roller separate state with the greatest distance D2 to the roller contact state to a timing when the image forming apparatus 1 completes the state-changing to the roller contact state; and a time from a timing when the image forming apparatus 1 starts state-changing from the roller contact state to the roller separate state to a timing when the image forming apparatus 1 returns to the roller contact state again. The time Δt2P may not necessarily be the same as the time Δt2 which is the actual required time. Further, for example, the motor control section 44 may estimate, as the time Δt7P, a time from the timing when the image forming apparatus 1 starts state-changing from the roller contact state to the roller separate state to a timing when the image forming apparatus 1 returns to the roller contact state again The time Δt7P may not necessarily be the same as the time Δt7 which is the actual required time.

Figure 11:
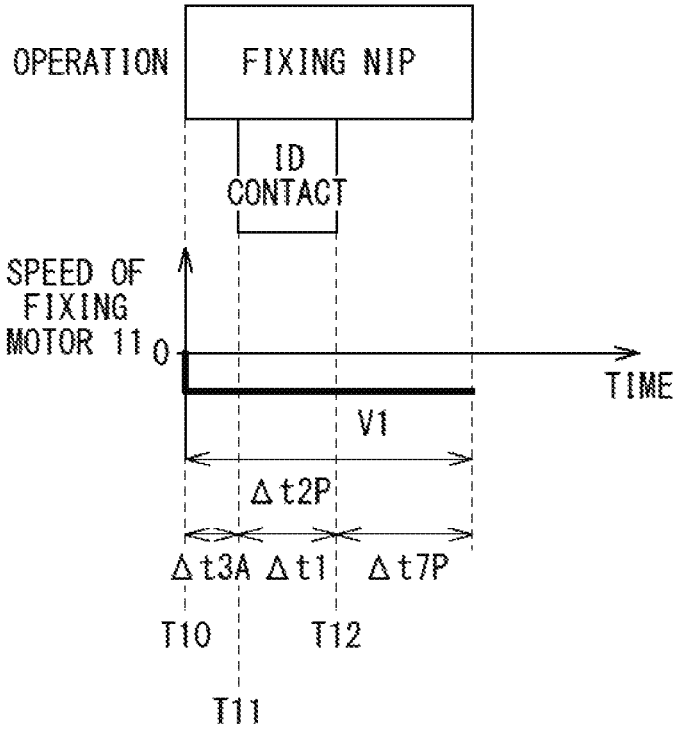
FIG. 11 is an explanatory diagram describing part of the warm-up operation of the image forming apparatus illustrated in FIG. 1.

FIG. 11 is an explanatory diagram for describing the provisional start timing TP of the fixing nip operation and the starting timing of the ID contact operation in a case where the time Δt2P exceeds the total time of the time Δt1 and the time Δt7P. In this case, the motor control section 44 may first determine the start timing TP. That is, the start timing TP may be the timing T10 that is the actual start timing of the fixing nip operation. Further, the motor control section 44 may so calculate a time Δt3A that the total time of the time Δt3A, the time Δt1, and the time Δt7P is substantially equal to the time Δt2P. That is, the motor control section 44 may determine the start timing of the ID contact operation to be a timing at which the time Δt3A has elapsed from the start timing TP. That is, the start timing of the ID contact operation may be the timing T11.

Figure 12:
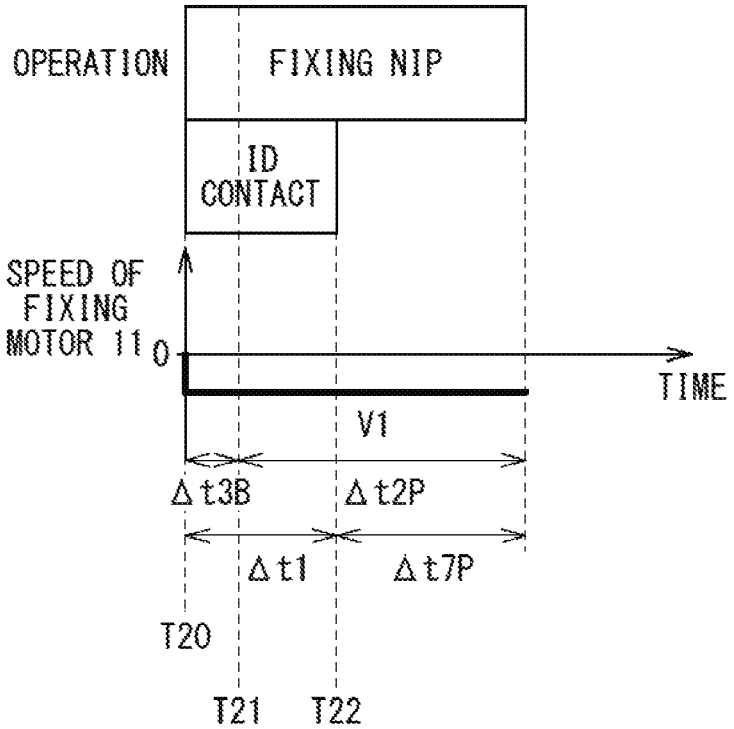
FIG. 12 is another explanatory diagram describing part of the warm-up operation of the image forming apparatus illustrated in FIG. 1.

FIG. 12 is an explanatory diagram for describing the provisional start timing TP of the fixing nip operation and the start timing of the ID contact operation in a case where the time Δt2P is equal to or less than the total time of the time Δt1 and the time Δt7P. In this case, the motor control section 44 may first determine the start timing of the ID contact operation. That is, the start timing of the ID contact operation may be the timing T20 that is the actual start timing of the ID contact operation. Further, the motor control section 44 may so calculate a time Δt3B that the total time of the time Δt3B and the time Δt2P is substantially equal to the total time of the time Δt1 and the time Δt7P. That is, the motor control section 44 may determine the start timing TP to be a timing at which the time Δt3B has elapsed from the timing T20. That is, the start timing TP may be the timing T21, and may not be the same as the timing T20 that is the actual start timing of the fixing nip operation. In other words, the start timing TP may be, for example, a virtual start timing in a case where the ID contact operation and the fixing nip operation are allowed to be performed independently of each other. Thus, the motor control section 44 may determine the provisional start timing TP of the fixing nip operation and the start timing of the ID contact operation.

Thereafter, the motor control section 44 may determine whether the start timing TP is before the start timing of the ID contact operation (step S102). In a case where the start timing TP is substantially the same as or after the start timing of the ID contact operation ("N" in step S102), the process may be caused to proceed to step S110.

In a case where the start timing TP is before the start timing of the ID contact operation ("Y" in step S102), the motor control section 44 may so control the fixing motor 11 that the fixing motor 11 rotates at the reverse-rotation speed V1 (step S103). This may cause the fixing motor 11 to generate driving force and cause the generated driving force to be transmitted to the roller separating mechanism 33. That is, the upper fixing roller 31*a* and the lower fixing roller 31*b* may be repeatedly caused to be in the roller contact state and the roller separate state alternately, causing the fixing section 30 to start the fixing nip operation at the timing T10 illustrated in FIG. 8 that is the start timing TP.

Thereafter, the motor control section 44 may determine whether the time Δt3A has elapsed from the timing T10 (step S104). In a case where the time Δt3A has not elapsed ("N" in step S104), the process in step S104 may be repeated.

In a case where the time Δt3A has elapsed ("Y" in step S104), the motor control section 44 may so control the clutch 12 that the clutch 12 transmits the driving force of the fixing motor 11 to the slider mechanism 28 (step S105). This may cause the clutch 12 to transmit the driving force generated by the rotation of the fixing motor 11 at the reverse-rotation speed V1. That is, the image formation-transfer section 20 may start the ID contact operation at the timing T11 illustrated in FIG. 8.

Thereafter, the slider-mechanism position determining section 41 may determine, on the basis of the detection result obtained by the slider-mechanism position sensor 13, whether the image formation-transfer section 20 is to complete the ID contact operation (step S106). In a case where the image formation-transfer section 20 is not to complete the ID contact operation ("N" in step S106), the process in step S106 may be repeated.

In a case where the image formation-transfer section 20 is to complete the ID contact operation ("Y" in step S106), the motor control section 44 may so control the clutch 12 that the clutch 12 cuts off the driving force of the fixing motor 11 to the slider mechanism 28 (step S107). This may cause the clutch 12 to cut off the driving force of the fixing motor 11. That is, the image formation-transfer section 20 may complete the ID contact operation at the timing T12 illustrated in FIG. 8.

Thereafter, the fixing-roller position determining section 43 may determine, on the basis of the detection result obtained by the fixing-roller position sensor 15, whether the fixing section 30 is to complete the fixing nip operation (step S108). In a case where the fixing section 30 is not to complete the fixing nip operation ("N" in step S108), the process in step S108 may be repeated.

In a case where the fixing section 30 is to complete the fixing nip operation ("Y" in step S108), the motor control section 44 may so control the fixing motor 11 that the fixing motor 11 stops (step S109). This may cause the fixing motor 11 to stop. That is, the fixing section 30 may complete the fixing nip operation at the timing T13 illustrated in FIG. 8.

In a case where the start timing TP is substantially the same as or after the start timing of the ID contact operation ("N" in step S102), the motor control section 44 may so control the clutch 12 that the clutch 12 transmits the driving force of the fixing motor 11 to the slider mechanism 28 (step S110). Thus, the clutch 12 may be allowed to transmit the driving force generated by the rotation of the fixing motor 11.

Thereafter, the motor control section 44 may so control the fixing motor 11 that the fixing motor 11 rotates at the reverse-rotation speed V1 (step S111). This may cause the fixing motor 11 to generate driving force and cause the generated driving force to be transmitted to the slider mechanism 28 and the roller separating mechanism 33. That is, the image formation-transfer section 20 may start the ID contact operation at the timing T20 illustrated in FIG. 9. Further, the upper fixing roller 31*a* and the lower fixing roller 31*b* may be repeatedly caused to be in the roller contact state and the roller separate state alternately, causing the fixing section 30 to start the fixing nip operation at the timing T20 illustrated in FIG. 9.

Thereafter, the motor control section 44 may determine whether the time Δt3B has elapsed from the timing T20 (step S112). In a case where the time Δt3B has not elapsed ("N" in step S112), the process in step S112 may be repeated.

In a case where the time Δt3B has elapsed ("Y" in step S112), the fixing section 30 may continue the fixing nip operation (step S113). That is, because the fixing section 30 has started the fixing nip operation in step S111, the fixing section 30 may have already been performing the fixing nip operation at the timing T21 illustrated in FIG. 9 which is the start timing TP. Therefore, the fixing section 30 may continue the fixing nip operation.

Thereafter, the slider-mechanism position determining section 41 may determine, on the basis of the detection result obtained by the slider-mechanism position sensor 13, whether the image formation-transfer section 20 is to complete the ID contact operation (step S114). In a case where the image formation-transfer section 20 is not to complete the ID contact operation ("N" in step S114), the process in step S114 may be repeated.

In a case where the image formation-transfer section 20 is to complete the ID contact operation ("Y" in step S114), the motor control section 44 may so control the clutch 12 that the clutch 12 cuts off the driving force of the fixing motor 11 to the slider mechanism 28 (step S115). This may cause the clutch 12 to cut off the driving force of the fixing motor 11. That is, the image formation-transfer section 20 may complete the ID contact operation at the timing T22 illustrated in FIG. 9.

Thereafter, the fixing-roller position determining section 43 may determine, on the basis of the detection result obtained by the fixing-roller position sensor 15, whether the fixing section 30 is to complete the fixing nip operation (step S116). In a case where the fixing section 30 is not to complete the fixing nip operation ("N" in step S116), the process in step S116 may be repeated.

In a case where the fixing section 30 is to complete the fixing nip operation ("Y" in step S116), the motor control section 44 may so control the fixing motor 11 that the fixing motor 11 stops (step S117). This may cause the fixing motor 11 to stop. That is, the fixing section 30 may complete the fixing nip operation at the timing T23 illustrated in FIG. 9.

Thereafter, the fixing-section temperature control section 42 may so perform control, on the basis of the detection result obtained by the temperature sensor 14, that the fixing section 30 starts the temperature adjustment operation (step S118). In one specific but non-limiting example, the fixing-section temperature control section 42 may so control the heater 32*a* and the heater 32*b* that the temperature adjustment operation is performed. This may cause the fixing section 30 to start the temperature adjustment operation at the timing T13 illustrated in FIG. 8 or at the timing T23 illustrated in FIG. 9.

Thereafter, the fixing-section temperature control section 42 may determine, on the basis of the detection result obtained by the temperature sensor 14, whether the fixing section 30 is to complete the temperature adjustment operation (step S119). In one specific but non-limiting example, the fixing-section temperature control section 42 may determine whether a temperature of the fixing section 30 has reached a predetermined temperature for the fixing warm-up operation, and thereby determine whether the fixing section 30 is to complete the temperature adjustment operation. In a case where the fixing section 30 is not to complete the temperature adjustment operation ("N" in the step S119), the process in step S119 may be repeated.

In a case where the fixing section 30 is to complete the temperature adjustment operation ("Y" in step S119), the motor control section 44 may so control the fixing motor 11 that the fixing motor 11 rotates at the forward-rotation speed V2 (step S120). This may cause the fixing motor 11 to generate driving force and cause the generated driving force to be transmitted to the upper fixing roller 31*a*. That is, at the timing T14 illustrated in FIG. 8 or at the timing T24 illustrated in FIG. 9, the fixing section 30 may complete the temperature adjustment operation and the fixing section 30 may start the fixing warm-up operation in the roller contact state. On this occasion, the fixing-section temperature control section 42 may so control the heater 32*a* and the heater 32*b* that the temperature of the upper fixing roller 31*a* and the temperature of the lower fixing roller 31*b* are adjusted.

Thereafter, the fixing-section temperature control section 42 may determine whether the fixing section 30 is to complete the fixing warm-up operation (step S121). In one specific but non-limiting example, the fixing-section temperature control section 42 may determine whether the temperature of the fixing section 30 has reached a predetermined temperature for printing, and thereby determine whether the fixing section 30 is to complete the fixing warm-up operation. In a case where the fixing section 30 is not to complete the fixing warm-up operation ("N" in step S121), the process in step S121 may be repeated.

In a case where the fixing section 30 is to complete the fixing warm-up operation ("Y" in step S121), the motor control section 44 may so control the fixing motor 11 that the fixing motor 11 rotates at the forward-rotation speed VP (step S122). This may cause the fixing motor 11 to generate driving force and cause the generated driving force to be transmitted to the upper fixing roller 31*a*. That is, at the timing T15 illustrated in FIG. 8 or at the timing T25 illustrated in FIG. 9, the fixing section 30 may complete the fixing warm-up operation and the fixing section 30 may start the fixing operation while conveying the medium PM in the roller contact state.

This may be an end of the flow.

[Warm-Up Operation Including ID Separation Operation]

Upon the warm-up operation, for example, in a case where the image forming apparatus 1 performs color printing and thereafter performs monochrome printing, the ID separation operation may be performed as the pre-printing preparation operation in the image formation-transfer section 20, and the fixing nip operation and the fixing warm-up operation may be performed as the pre-printing preparation operation in the fixing section 30. The apparatus controller 40 may start the warm-up operation in response to reception of the print instruction. This operation is described in detail below.

Figure 13:
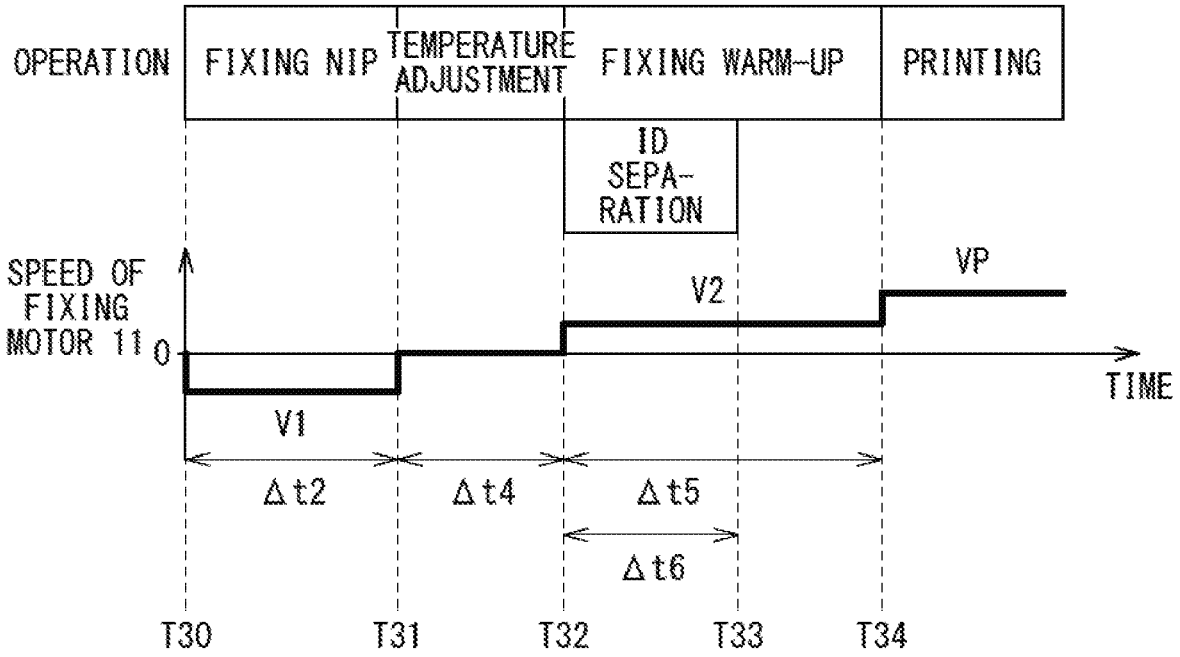
FIG. 13 is another sequence diagram illustrating an example of the warm-up operation of the image forming apparatus illustrated in FIG. 1.

FIG. 13 is a sequence diagram illustrating an example of the warm-up operation including the ID separation operation. In this example, the image forming apparatus 1 may start the fixing nip operation at a timing T30, and complete the fixing nip operation at a timing T31. The time Δt2 may be from the timing T30 to the timing T31 in this example. Upon the fixing nip operation, the fixing motor 11 may rotate at the reverse-rotation speed V1. The image forming apparatus 1 may start the temperature adjustment operation at the timing T31, and complete the temperature adjustment operation at a timing T32. The time Δt4 may be from the timing T31 to the timing T32 in this example. The fixing motor 11 may be stopped upon the temperature adjustment operation. The image forming apparatus 1 may start the fixing warm-up operation at the timing T32, and complete the fixing warm-up operation at a timing T34. The time Δt5 may be from the timing T32 to the timing T34 in this example. Upon the fixing warm-up operation, the fixing motor 11 may rotate at the forward-rotation speed V2. Further, the image forming apparatus 1 may start the ID separation operation at the timing T32, and complete the ID separation operation at a timing T33 before the timing T34. The time Δt6 may be a required time for the ID separation operation. The time Δt6 may be from the timing T32 to the timing T33 in this example. Thereafter, the image forming apparatus 1 may start printing at the timing T34. At and after the timing T34, the fixing motor 11 may rotate at the forward-rotation speed VP.

Figure 14:
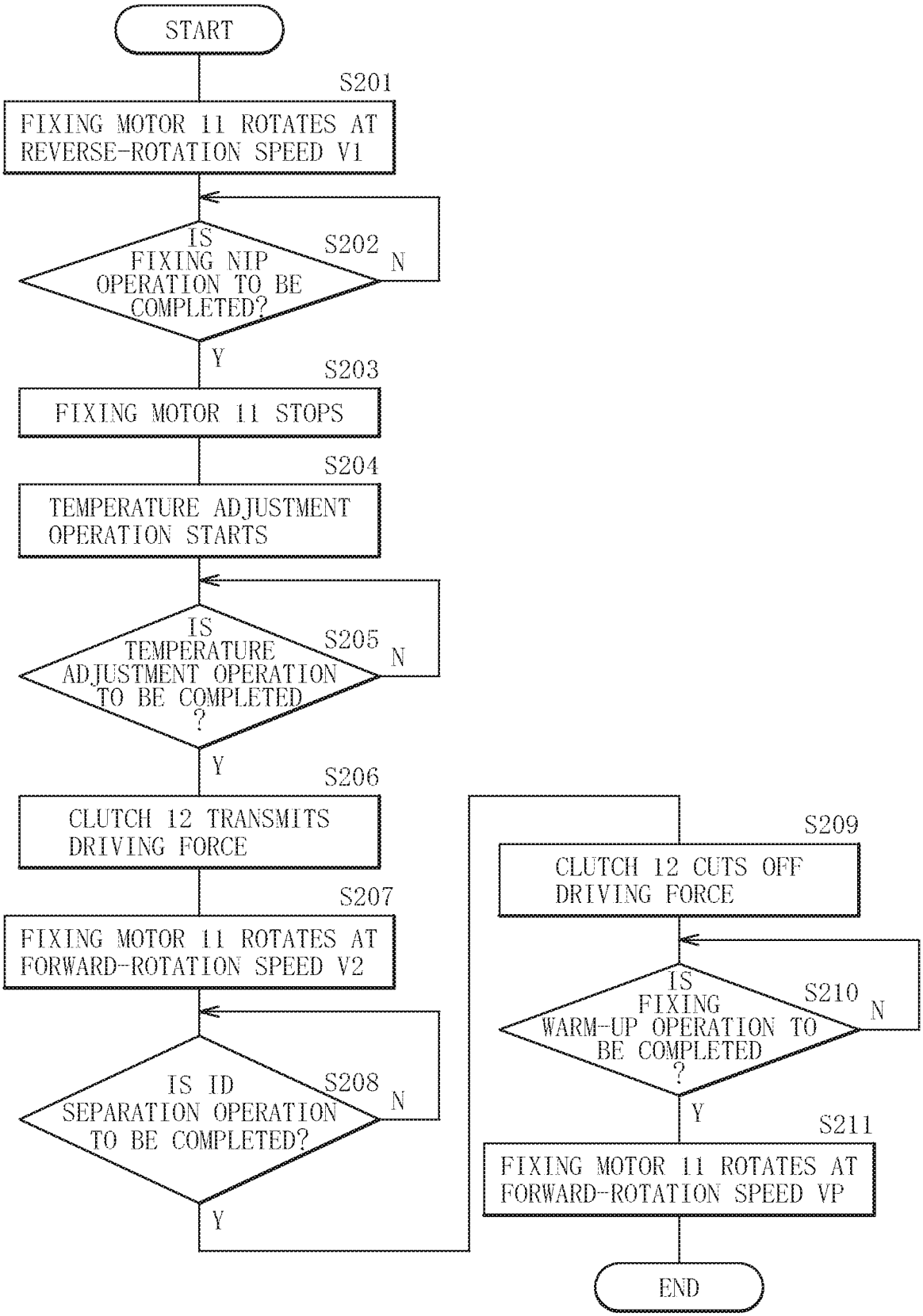
FIG. 14 is a flowchart illustrating an example of the warm-up operation of the image forming apparatus illustrated in FIG. 1.

FIG. 14 is a flowchart illustrating an example of the warm-up operation of the image forming apparatus 1. First, the motor control section 44 may so control the fixing motor 11 that the fixing motor 11 rotates at the reverse-rotation speed V1 (step S201). This may cause the fixing motor 11 to generate driving force and cause the generated driving force to be transmitted to the roller separating mechanism 33. That is, the upper fixing roller 31*a* and the lower fixing roller 31*b* may be repeatedly caused to be in the roller contact state and the roller separate state alternately, causing the fixing section 30 to start the fixing nip operation at the timing T30 illustrated in FIG. 13.

Thereafter, the fixing-roller position determining section 43 may determine, on the basis of the detection result obtained by the fixing-roller position sensor 15, whether the fixing section 30 is to complete the fixing nip operation (step S202). In a case where the fixing section 30 is not to complete the fixing nip operation ("N" in step S202), the process in step S202 may be repeated.

In a case where the fixing section 30 is to complete the fixing nip operation ("Y" in step S202), the motor control section 44 may so control the fixing motor 11 that the fixing motor 11 stops (step S203). This may cause the fixing motor 11 to stop. That is, the fixing section 30 may complete the fixing nip operation at the timing T31 illustrated in FIG. 13.

Thereafter, the fixing-section temperature control section 42 may so perform control, on the basis of the detection result obtained by the temperature sensor 14, that the fixing section 30 starts the temperature adjustment operation (step S204). That is, the fixing section 30 may start the temperature adjustment operation at the timing T31 illustrated in FIG. 13.

Thereafter, the fixing-section temperature control section 42 may determine, on the basis of the detection result obtained by the temperature sensor 14, whether the fixing section 30 is to complete the temperature adjustment operation (step S205). In a case where the fixing section 30 is not to complete the temperature adjustment operation ("N" in the step S205), the process in the step S205 may be repeated.

In a case where the fixing section 30 is to complete the temperature adjustment operation ("Y" in step S205), the motor control section 44 may so control the clutch 12 that the clutch 12 transmits the driving force of the fixing motor 11 to the slider mechanism 28 (step S206). This may allow the clutch 12 to transmit the driving force generated by the rotation of the fixing motor 11.

Thereafter, the motor control section 44 may so control the fixing motor 11 that the fixing motor 11 rotates at the forward-rotation speed V2 (step S207). This may cause the fixing motor 11 to generate driving force and cause the generated driving force to be transmitted to the slider mechanism 28 and the upper fixing roller 31*a*. That is, at the timing T32 illustrated in FIG. 13, the image formation-transfer section 20 may start the ID separation operation, and the fixing section 30 may start the fixing warm-up operation in the roller contact state. On this occasion, the fixing-section temperature control section 42 may so control the heater 32*a* and the heater 32*b* that the temperature of the upper fixing roller 31*a* and the temperature of the lower fixing roller 31*b* are adjusted.

Thereafter, the slider-mechanism position determining section 41 may determine, on the basis of the detection result obtained by the slider-mechanism position sensor 13, whether the image formation-transfer section 20 is to complete the ID separation operation (step S208). In a case where the image formation-transfer section 20 is not to complete the ID separation operation ("N" in step S208), the process in step S208 may be repeated.

In a case where the image formation-transfer section 20 is to complete the ID separation operation ("Y" in step S208), the motor control section 44 may so control the clutch 12 that the clutch 12 cuts off the driving force of the fixing motor 11 to the slider mechanism 28 (step S209). This may cause the clutch 12 to cut off the driving force of the fixing motor 11. That is, the image formation-transfer section 20 may complete the ID separation operation at the timing T33 illustrated in FIG. 13.

Thereafter, the fixing-section temperature control section 42 may determine whether the fixing section 30 is to complete the fixing warm-up operation (step S210). In a case where the fixing section 30 is not to complete the fixing warm-up operation ("N" in step S210), the process in step S210 may be repeated.

In a case where the fixing section 30 is to complete the fixing warm-up operation ("Y" in step S210), the motor control section 44 may so control the fixing motor 11 that the fixing motor 11 rotates at the forward-rotation speed VP (step S211). This may cause the fixing motor 11 to generate driving force and cause the generated driving force to be transmitted to the upper fixing roller 31*a*. That is, at the timing T34 illustrated in FIG. 13, the fixing section 30 may complete the fixing warm-up operation, and the fixing section 30 may start the fixing operation while conveying the medium PM in the roller contact state.

This may be an end of the flow.

[1.3 Example Workings of Warm-Up Operation]

Next, example workings of the example embodiment are described in comparison with a comparative example. An image forming apparatus 1R according to the comparative example performs the ID contact operation and thereafter performs the fixing nip operation in a case of performing the ID contact, and performs the fixing warm-up operation and thereafter performs the ID separation operation in a case of performing the ID separation operation. The image forming apparatus 1R includes a motor control section 44R. Other configurations are similar to those according to the example embodiment illustrated in FIGS. 1 to 6. The warm-up operation of the image forming apparatus 1R is described below with reference to specific examples.

[Warm-Up Operation Including ID Contact Operation]

Figure 15:
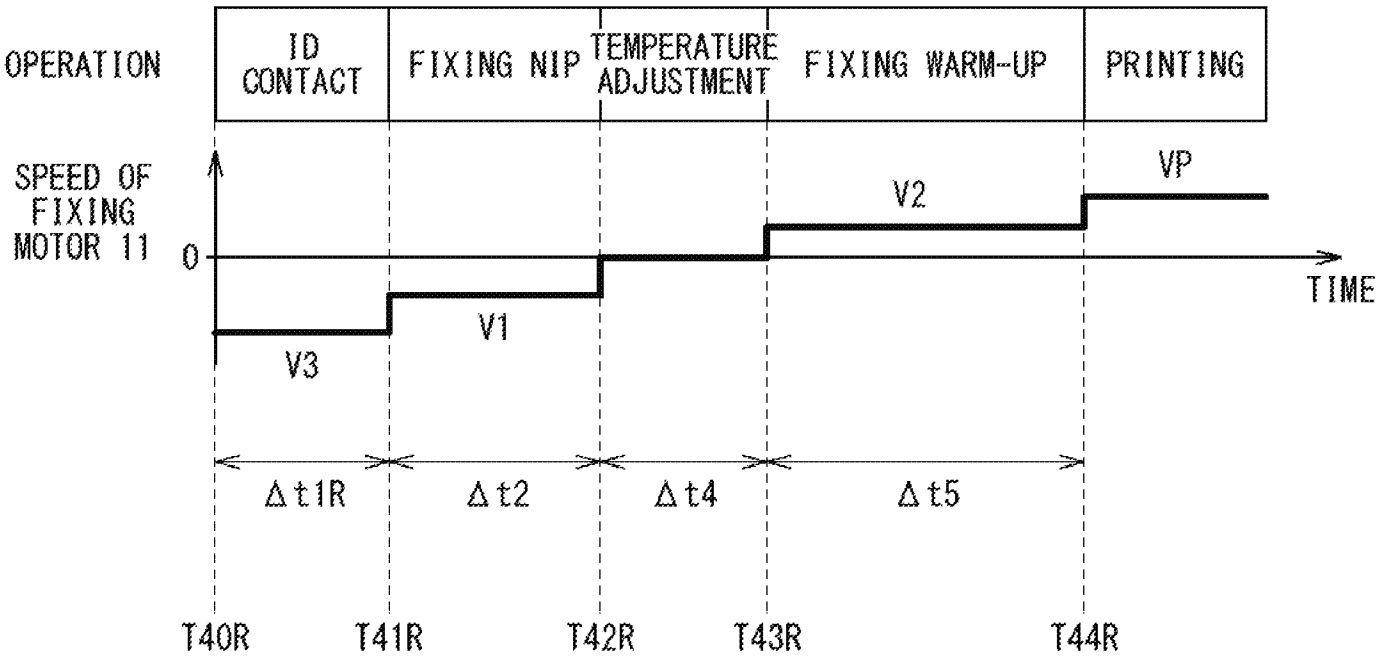
FIG. 15 is a sequence diagram illustrating an example of warm-up operation of an image forming apparatus according to a comparative example.

FIG. 15 is a sequence diagram illustrating an example of the warm-up operation of the image forming apparatus 1R according to the comparative example. In this example, the image forming apparatus 1R starts the ID contact operation at a timing T40R, and completes the ID contact operation at a timing T41R. A time Δt1R is a required time for the ID contact operation. The time Δt1R is from the timing T40R to the timing T41R in this example. Regarding the ID contact operation, the time Δt1R is shorter than the time Δt1 because the fixing motor 11 rotates at the reverse-rotation speed V3. The image forming apparatus 1R starts the fixing nip operation at the timing T41R, and completes the fixing nip operation at a timing T42R. The time Δt2 is from the timing T41R to the timing T42R in this example. Upon the fixing nip operation, the fixing motor 11 rotates at the reverse-rotation speed V1. The image forming apparatus 1R starts the temperature adjustment operation at the timing T42R, and completes the temperature adjustment operation at a timing T43R. The time Δt4 is from the timing T42R to the timing T43R in this example. The fixing motor 11 is stopped upon the temperature adjustment operation. The image forming apparatus 1R starts the fixing warm-up operation at the timing T43R, and completes the fixing warm-up operation at a timing T44R. The time Δt5 is from the timing T43R to the timing T44R in this example. Upon the fixing warm-up operation, the fixing motor 11 rotates at the forward-rotation speed V2. Thereafter, the image forming apparatus 1R starts printing at the timing T44R. At and after the timing T44R, the fixing motor 11 rotates at the forward-rotation speed VP.

Figure 16:
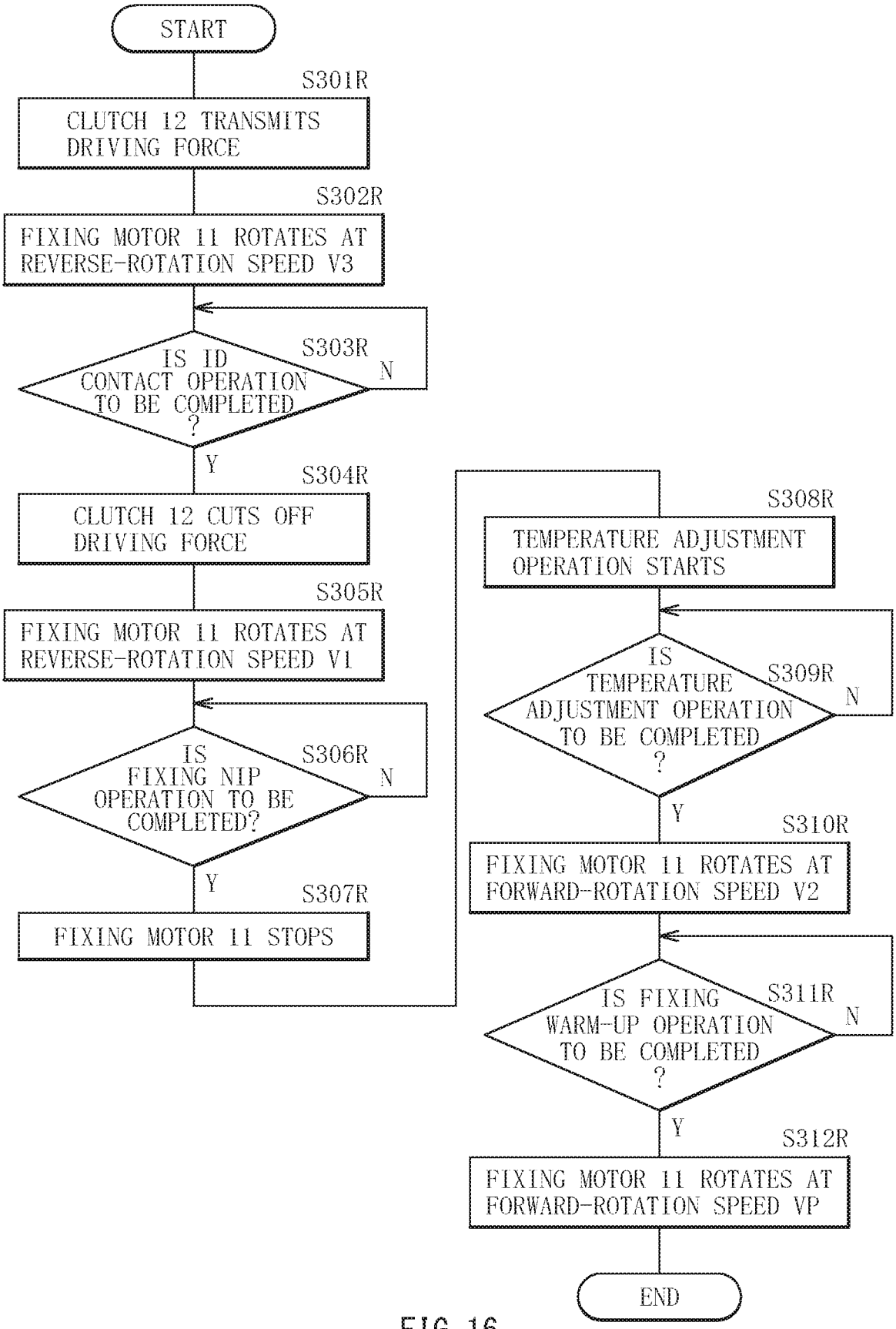
FIG. 16 is a flowchart illustrating an example of the warm-up operation of the image forming apparatus according to the comparative example.

FIG. 16 is a flowchart illustrating an example of the warm-up operation of the image forming apparatus 1R. The motor control section 44R so controls the clutch 12 that the clutch 12 transmits the driving force of the fixing motor 11 to the slider mechanism 28 (step S301R). Thereafter, the motor control section 44R so controls the fixing motor 11 that the fixing motor 11 rotates at the reverse-rotation speed V3 (step S302R). This causes the fixing motor 11 to generate driving force and causes the generated driving force to be transmitted to the slider mechanism 28. That is, the image formation-transfer section 20 starts the ID contact operation at the timing T40R illustrated in FIG. 15. The fixing motor 11 also attempts to transmit the generated driving force to the roller separating mechanism 33 as well. However, in a case where the fixing motor 11 rotates at the reverse-rotation speed V3, the fixing motor 11 does not transmit the driving force to the roller separating mechanism 33 because the driving force for the fixing nip operation is insufficient. That is, the fixing section 30 does not start the fixing nip operation at the timing T40R. Thereafter, the slider-mechanism position determining section 41 determines whether the image formation-transfer section 20 is to complete the ID contact operation (step S303R). In a case where the image formation-transfer section 20 is not to complete the ID contact operation ("N" in step S303R), the process in step S303R is repeated. In a case where the image formation-transfer section 20 is to complete the ID contact operation ("Y" in step S303R), the motor control section 44R so controls the clutch 12 that the clutch 12 cuts off the driving force of the fixing motor 11 to the slider mechanism 28 (step S304R). That is, the image formation-transfer section 20 completes the ID contact operation at the timing T41R illustrated in FIG. 15. Thereafter, the motor control section 44R so controls the fixing motor 11 that the fixing motor 11 rotates at the reverse-rotation speed V1 (step S305R). That is, the fixing section 30 starts the fixing nip operation at the timing T41R illustrated in FIG. 15. Thereafter, the fixing-roller position determining section 43 determines whether the fixing section 30 is to complete the fixing nip operation (step S306R). In a case where the fixing section 30 is not to complete the fixing nip operation ("N" in step S306R), the process in step S306R is repeated. In a case where the fixing section 30 is to complete the fixing nip operation ("Y" in step S306R), the motor control section 44R so controls the fixing motor 11 that the fixing motor 11 stops (step S307R). That is, the fixing section 30 completes the fixing nip operation at the timing T42R illustrated in FIG. 15. Thereafter, the fixing-section temperature control section 42 so performs control that the fixing section 30 starts the temperature adjustment operation (step S308R). That is, the fixing section 30 starts the temperature adjustment operation at the timing T43R illustrated in FIG. 15. Thereafter, the fixing-section temperature control section 42 determines whether the fixing section 30 is to complete the temperature adjustment operation (step S309R). In a case where the fixing section 30 is not to complete the temperature adjustment operation ("N" in step S309R), the process in step S309R is repeated. In a case where the fixing section 30 is to complete the temperature adjustment operation ("Y" in step S309R), the motor control section 44R so controls the fixing motor 11 that the fixing motor 11 rotates at the forward-rotation speed V2 (step S310R). That is, at the timing T43R illustrated in FIG. 15, the fixing section 30 completes the temperature adjustment operation, and the fixing section 30 starts the fixing warm-up operation in the roller contact state. Thereafter, the fixing-section temperature control section 42 determines whether the fixing section 30 is to complete the fixing warm-up operation (step S311R). In a case where the fixing section 30 is not to complete the fixing warm-up operation ("N" in step S311R), the process in step S311R is repeated. In a case where the fixing section 30 is to complete the fixing warm-up operation ("Y" in step S311R), the motor control section 44R so controls the fixing motor 11 that the fixing motor 11 rotates at the forward-rotation speed VP (step S312R). That is, at the timing T44R illustrated in FIG. 15, the fixing section 30 completes the fixing warm-up operation, and the fixing section 30 starts the fixing operation while conveying the medium PM in the roller contact state. This is an end of the flow.

Regarding the image forming apparatus 1R according to the comparative example, the required time for the ID contact operation and the fixing nip operation is the total time of the time Δt1R and the time Δt2, as illustrated in FIG. 15. In contrast, the required time for the ID contact operation and the fixing nip operation regarding the image forming apparatus 1 may be the time Δt2 as illustrated in FIGS. 8 and 9, which may be shorter than the required time for the ID contact operation and the fixing nip operation regarding the image forming apparatus 1R.

[Warm-Up Operation Including ID Separation Operation]

Figure 17:
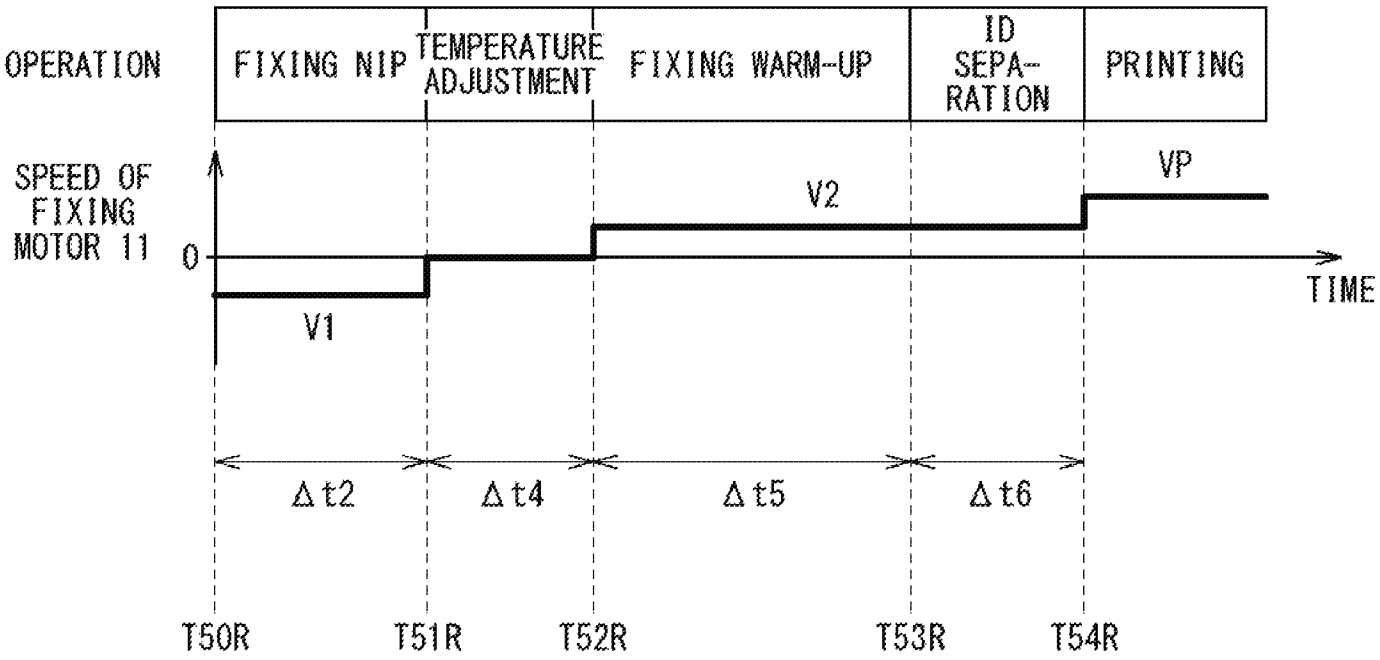
FIG. 17 is another sequence diagram illustrating an example of the warm-up operation of the image forming apparatus according to the comparative example.

FIG. 17 is a sequence diagram illustrating an example of the warm-up operation of the image forming apparatus 1R. In this example, the image forming apparatus 1R starts the fixing nip operation at a timing T50R, and completes the fixing nip operation at a timing T51R. The time Δt2 is from the timing T50R to the timing T51R in this example. Upon the fixing nip operation, the fixing motor 11 rotates at the reverse-rotation speed V1. The image forming apparatus 1R starts the temperature adjustment operation at the timing T51R, and completes the temperature adjustment operation at a timing T52R. The time Δt4 is from the timing T51R to the timing T52R in this example. The fixing motor 11 is stopped upon the temperature adjustment operation. The image forming apparatus 1R starts the fixing warm-up operation at the timing T52R, and completes the fixing warm-up operation at a timing T53R. The time Δt5 is from the timing T52R to the timing T53R in this example. Upon the fixing warm-up operation, the fixing motor 11 rotates at the forward-rotation speed V2. The image forming apparatus 1R starts the ID separation operation at the timing T53R, and completes the ID separation operation at a timing T54R. The time Δt6 is from the timing T53R to the timing T54R in this example. Upon the ID separation operation, the fixing motor 11 rotates at the forward-rotation speed V2. Thereafter, the image forming apparatus 1R starts printing at the timing T54R. At and after the timing T54R, the fixing motor 11 rotates at the forward-rotation speed VP.

Figure 18:
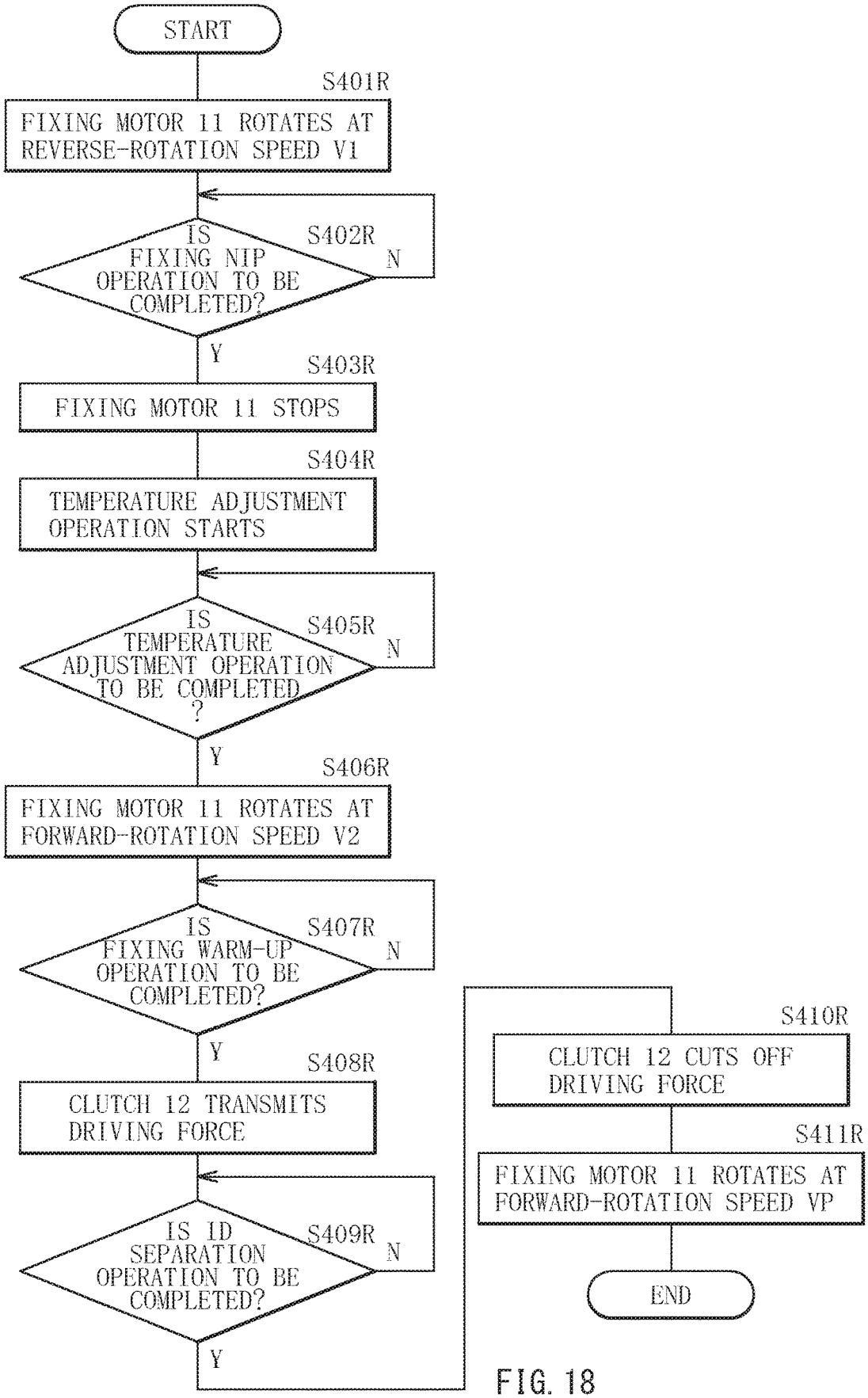
FIG. 18 is another flowchart illustrating an example of the warm-up operation of the image forming apparatus according to the comparative example.

FIG. 18 is a flowchart illustrating an example of the warm-up operation of the image forming apparatus 1R. First, the motor control section 44R so controls the fixing motor 11 that the fixing motor 11 rotates at the reverse-rotation speed V1 (step S401R). That is, the fixing section 30 starts the fixing nip operation at the timing T50R illustrated in FIG. 17. Thereafter, the fixing-roller position determining section 43 determines whether the fixing section 30 is to complete the fixing nip operation (step S402R). In a case where the fixing section 30 is not to complete the fixing nip operation ("N" in step S402R), the process in step S402R is repeated. In a case where the fixing section 30 is to complete the fixing nip operation ("Y" in step S402R), the motor control section 44R so controls the fixing motor 11 that the fixing motor 11 stops (step S403R). That is, the fixing section 30 completes the fixing nip operation at the timing T51R illustrated FIG. 17. Thereafter, the fixing-section temperature control section 42 so controls the fixing section 30 that the fixing section 30 starts the temperature adjustment operation (step S404R). That is, the fixing section 30 starts the temperature adjustment operation at the timing T51R illustrated in FIG. 17. Thereafter, the fixing-section temperature control section 42 determines whether the fixing section 30 is to complete the temperature adjustment operation (step S405R). In a case where the fixing section 30 is not to complete the temperature adjustment operation ("N" in step S405R), the process in the step S405R is repeated. In a case where the fixing section 30 is to complete the temperature adjustment operation ("Y" in step S405R), the motor control section 44R so controls the fixing motor 11 that the fixing motor 11 rotates at the forward-rotation speed V2 (step S406R). That is, the fixing section 30 starts the fixing warm-up operation in the roller contact state at the timing T52R illustrated in FIG. 17. Thereafter, the fixing-section temperature control section 42 determines whether the fixing section 30 is to complete the fixing warm-up operation (step S407R). In a case where the fixing section 30 is not to complete the fixing warm-up operation ("N" in step S407R), the process in step S407R is repeated. In a case where the fixing section 30 is to complete the fixing warm-up operation ("Y" in step S407R), the motor control section 44R so controls the clutch 12 that the clutch 12 transmits the driving force of the fixing motor 11 to the slider mechanism 28 (step S408R). That is, at the timing T53R illustrated in FIG. 17, the fixing section 30 completes the fixing warm-up operation, and the image formation-transfer section 20 starts the ID separation operation. This prevents the fixing section 30 from performing the fixing warm-up operation, but causes the upper fixing roller 31*a* and the lower fixing roller 31*b* to continue rotating. Thereafter, the slider-mechanism position determining section 41 determines whether the image formation-transfer section 20 is to complete the ID separation operation (step S409R). In a case where the image formation-transfer section 20 is not to complete the ID separation operation ("N" in step S409R), the process in step S409R is repeated. In a case where the image formation-transfer section 20 is to complete the ID separation operation ("Y" in step S409R), the motor control section 44R so controls the clutch 12 that the clutch 12 cuts off the driving force of the fixing motor 11 to the slider mechanism 28 (step S410R). That is, the image formation-transfer section 20 completes the ID separation operation at the timing T54R illustrated in FIG. 17. The motor control section 44R so controls the fixing motor 11 that the fixing motor 11 rotates at the forward-rotation speed VP (step S411R). That is, the fixing section 30 starts the fixing operation while conveying the medium PM in the roller contact state at the timing T54R illustrated in FIG. 17. This is an end of the flow.

Regarding the image forming apparatus 1R according to the comparative example, the required time for the ID separation operation and the fixing warm-up operation is the total time of the time Δt5 and the time Δt6, as illustrated in FIG. 17. In contrast, the required time for the ID separation operation and the fixing warm-up operation regarding the image forming apparatus 1 may be the time Δt5, as illustrated in FIG. 13, which may be shorter than the required time for the ID separation operation and the fixing warm-up operation regarding the image forming apparatus 1R.

As described above, in the image forming apparatus 1, the belt 21 and photosensitive drums 24Y, 24M, and 24C in the image formation-transfer section 20 may state-change between the drum contact state and the drum separate state. The upper fixing roller 31*a* and the lower fixing roller 31*b* in the fixing section 30 may state-change between the roller separate state and the roller contact state. Further, the motor control section 44 may so control the fixing motor 11 and the clutch 12 that part or all of the period in which the fixing section 30 state-changes from the roller separate state to the roller contact state and part or all of the period in which the image formation-transfer section 20 state-changes from the drum separate state to the drum contact state overlap each other. Accordingly, it is possible to suppress an increase in the required time for the warm-up operation also in a case where the number of motors is reduced in the image forming apparatus 1.

In one example embodiment, in the image forming apparatus 1, the fixing motor 11 may generate the driving force by rotating at the reverse-rotation speed V1, which is the lower speed of the reverse-rotation speed V1 and the reverse-rotation speed V3, in the time Δt2 and the time Δt1. This allows the image forming apparatus 1 to perform the ID contact operation together with the fixing nip operation. Further, the fixing motor 11 may rotate at the highest speed of the speeds that allow for both the fixing nip operation and the ID contact operation. This allows for reduction in the required time for the ID contact operation. Therefore, it is possible to suppress an increase in the required time for the warm-up operation also in the case where the number of motors is reduced.

Moreover, in the image forming apparatus 1, the belt 21 and the photosensitive drums 24Y, 24M, and 24C in the image formation-transfer section 20 may state-change between the drum contact state and the drum separate state. The upper fixing roller 31*a* and the lower fixing roller 31*b* in the fixing section 30 may state-change between the roller separate state and the roller contact state. Further, the fixing motor 11 and the clutch 12 may be so controlled that part or all of the period in which the fixing section 30 performs the fixing warm-up operation in the roller contact state and part or all of the period in which the image formation-transfer section 20 state-changes from the drum contact state to the drum separate state overlap each other. Accordingly, it is possible to suppress an increase in the required time for the warm-up operation also in the case where the number of motors is reduced in the image forming apparatus 1.

Moreover, in the image forming apparatus 1, the state-changing between the drum contact state and the drum separate state may be allowed by the driving force of the fixing motor 11, and the state-changing between the roller contact state and the roller separate state may be allowed by the driving force of the fixing motor 11. This allows for reduction in the number of the motors to be used in the image forming apparatus 1, making it possible to reduce a cost.

Moreover, in the image forming apparatus 1, the belt 21 and the photosensitive drums 24Y, 24M, and 24C in the image formation-transfer section 20 may state-change between the drum contact state and the drum separate state. Accordingly, in the image forming apparatus 1, each of the photosensitive drums 24Y, 24M, 24C and the belt 21 or the medium PM may not be in contact with each other. This makes it possible to prevent deterioration due to wearing of the photosensitive drums 24Y, 24M, 24C and the belt 21 or the medium PM.

Moreover, in the image forming apparatus 1, the upper fixing roller 31*a* and the lower fixing roller 31*b* in the fixing section 30 may state-change between the roller separate state and the roller contact state. Accordingly, in the image forming apparatus 1, the upper fixing roller 31*a* and the lower fixing roller 31*b* are not in contact with each other in the roller separate state. It is therefore possible to prevent deformation of the upper fixing roller 31*a* and the lower fixing roller 31*b* resulting from pressure.

[1.4 Example Effects]

As described above, according the example embodiment, the belt 21 and the photosensitive drums 24Y, 24M, and 24C may state-change between the drum contact state and the drum separate state. The upper fixing roller 31*a* and the lower fixing roller 31*b* may state-change between the roller separate state and the roller contact state. Further, the motor control section 44 may so control the fixing motor 11 and the clutch 12 that part or all of the period in which the fixing section 30 state-changes from the roller separate state to the roller contact state and part or all of the period in which the image formation-transfer section 20 state-changes from the drum separate state to the drum contact state overlap each other. Accordingly, it is possible to suppress an increase in the required time for the warm-up operation also in a case where the number of motors is reduced.

According to the example embodiment, the fixing motor 11 may generate the driving force by rotating at the reverse-rotation speed V1, which is the lower speed of the reverse-rotation speed V1 and the reverse-rotation speed V3, in the time Δt2 and the time Δt1. This allows the ID contact operation to be performed together with the fixing nip operation. Further, the required time for the ID contact operation is allowed to be reduced. Therefore, it is possible to suppress an increase in the required time for the warm-up operation also in the case where the number of motors is reduced.

According to the example embodiment, the belt 21 and the photosensitive drums 24Y, 24M, and 24C may state-change between the drum contact state and the drum separate state. The upper fixing roller 31*a* and the lower fixing roller 31*b* may state-change between the roller separate state and the roller contact state. Further, the fixing motor 11 and the clutch 12 may be so controlled that part or all of the period in which the fixing section 30 performs the fixing warm-up operation in the roller contact state and part or all of the period in which the image formation-transfer section 20 state-changes from the drum contact state to the drum separate state overlap each other. Accordingly, it is possible to suppress an increase in the required time for the warm-up operation also in the case where the number of motors is reduced.

According to the example embodiment, the state-changing between the drum contact state and the drum separate state may be allowed by the driving force of the fixing motor 11, and the state-changing between the roller contact state and the roller separate state may be allowed by the driving force of the fixing motor 11. This allows for reduction in the number of the motors to be used, making it possible to reduce a cost.

According to the example embodiment, the belt 21 and the photosensitive drums 24Y, 24M, and 24C may state-change between the drum contact state and the drum separate state. Accordingly, it is possible to prevent deterioration due to wearing of the photosensitive drums 24Y, 24M, and 24C and the belt 21 or the medium PM.

According to the example embodiment, the upper fixing roller 31*a* and the lower fixing roller 31*b* may state-change between the roller separate state and the roller contact state. Accordingly, it is possible to prevent deformation of the upper fixing roller 31*a* and the lower fixing roller 31*b* resulting from pressure.

2. Modifications

[Modification 1]

According to the example embodiment described above, as illustrated in FIG. 7, the speed for the ID contact operation and the fixing nip operation may be set to the reverse-rotation speed V1, and the speed for the ID separation operation and the fixing warm-up operation may be set to the forward-rotation speed V2; however, this is non-limiting. Alternatively, in one example embodiment, the speed for the ID contact operation and the fixing nip operation may be lower than the reverse-rotation speed V1. In another example embodiment, the speed for the ID separation operation and the fixing warm-up operation may be lower than the forward-rotation speed V2. In still another example embodiment, the speed for the ID contact operation and the fixing nip operation may be lower than the reverse-rotation speed V1, and the speed for the ID separation operation and the fixing warm-up operation may be lower than the forward-rotation speed V2.

FIG. 19 is an explanatory diagram illustrating an example of a motor speed table 45R according to the present modification (Modification 1). In a case where an image forming apparatus according to Modification 1 performs the fixing nip operation together with the ID contact operation, the speed of the fixing motor 11 may be set to a reverse-rotation speed V4. In a case where the image forming apparatus according to Modification 1 performs the fixing warm-up operation together with the ID separation operation, the speed of the fixing motor 11 may be set to a forward-rotation speed V5. The reverse-rotation speed V4 may be lower than the reverse-rotation speed V1, and the forward-rotation speed V5 may be lower than the forward-rotation speed V2. That is, for example, in a case where the ID contact operation and the fixing nip operation are performed, a load on the fixing motor 11 may be greater than that in a case where only one of the ID contact operation and the fixing nip operation is performed. Accordingly, there may be a possibility that the driving force for the fixing nip operation or the driving force for the ID contact operation is insufficient. In such a case, the speed of the fixing motor 11 may be set to be lower than the reverse-rotation speed V1, thereby increasing torque to be generated by the fixing motor 11. Therefore, the image forming apparatus according to Modification 1 is allowed to perform the fixing nip operation together with the ID contact operation. Similarly, in a case where the ID separation operation and the fixing warm-up operation are performed, the speed of the fixing motor 11 may be set lower than the forward-rotation speed V2, thereby increasing the torque to be generated by the fixing motor 11. Therefore, the image forming apparatus according to Modification 1 is allowed to perform the fixing warm-up operation together with the ID separation operation.

[Modification 2]

According to the example embodiment described above, the rotation of the fixing motor 11 in the forward rotation direction may cause the image formation-transfer section 20 to perform the ID separation operation, and the rotation of the fixing motor 11 in the reverse rotation direction may cause the image formation-transfer section 20 to perform the ID contact operation; however, this is non-limiting. Alternatively, in one example embodiment, the rotation of the fixing motor in the forward rotation direction may cause the image formation-transfer section 20 to perform the ID contact operation, and the rotation of the fixing motor in the reverse rotation direction may cause the image formation-transfer section 20 to perform the ID separation operation.

[Modification 3]

According to the example embodiment described above, the rotation of the fixing motor 11 may allow the image formation-transfer section 20 to state-change between the drum separate state and the drum contact state; however, this is non-limiting. Alternatively, in one example embodiment, rotation of a motor other than the fixing motor 11 may allow the image formation-transfer section 20 to state-change between the drum separate state and the drum contact state. Non-limiting examples of the motor other than the fixing motor 11 may include a discharging motor adapted to discharge the medium PM.

[Other Modifications]

Moreover, a combination of two or more of the modifications described above may be adopted.

Although the technology has been described with reference to some example embodiments and the modifications thereof, the technology is not limited thereto, and may be modified in a variety of ways.

For example, according to the example embodiment, etc. described above, the image formation on the medium PM may be performed by the electrophotographic method; however, this is non-limiting, and any method may be used to perform the image formation. Further, according to the example embodiment, etc. described above, the four photosensitive drums 24 may be provided to form images of four colors including black, yellow, magenta, and cyan; however, this is non-limiting. Alternatively, in one example embodiment, the photosensitive drum 24K may be provided to form a black image and one or more photosensitive drums 24 may be provided to form one or more color images.

For example, the example embodiment, etc. described above may be applied to a single-function printer; however, this is non-limiting. In one example embodiment, one embodiment of the technology may be applied to a so-called multifunctional peripheral (MFP) having functions including, without limitation, a copy function, a facsimile function, a scanning function, and a printing function.

For example, according to the example embodiment, etc. described above, the toner image formed by the image formation-transfer section 20 may be directly transferred onto the medium PM; however, this is non-limiting. Alternatively, in one example embodiment, the toner image formed by the image formation-transfer section may be once transferred onto an intermediate transfer belt, and the toner image transferred onto the intermediate transfer belt may be transferred onto the medium PM.

Furthermore, the technology encompasses any possible combination of some or all of the various embodiments and the modifications described herein and incorporated herein. It is possible to achieve at least the following configurations from the above-described example embodiments of the technology.

(1)

An image forming apparatus including:

a motor that generates driving force;

an image formation-transfer section that includes an image carrier and a transfer section, the image formation-transfer section state-changing between a first contact state and a first separate state by the driving force generated by the motor, the first contact state being a state in which the image carrier and the transfer section are in contact with each other, the first separate state being a state in which the image carrier and the transfer section are separated away from each other, the image formation-transfer section forming a developer image on a medium or the transfer section in the first contact state;

a switching mechanism that transmits and cuts off the driving force to the image formation-transfer section;

a fixing section that includes a first rotating member and a second rotating member, the fixing section state-changing between a second contact state and a second separate state by the driving force generated by the motor, the second contact state being a state in which the first rotating member and the second rotating member are in contact with each other, the second separate state being a state in which the first rotating member and the second rotating member are separated away from each other, the fixing section performing fixing operation in the second contact state, the fixing operation being operation of fixing the developer image to the medium; and a controller that controls the motor and the switching mechanism and thereby causes part or all of a first period and part or all of a second period to overlap each other, the first period being a period in which the fixing section state-changes from the second separate state to the second contact state, the second period being a period in which the image formation-transfer section state-changes from the first separate state to the first contact state.

(2)

The image forming apparatus according to (1), in which the fixing section is allowed to state-change from the second separate state to the second contact state in a case where the driving force generated by the motor is equal to or greater than driving force to be generated by rotation of the motor at a first rotational speed, the image formation-transfer section is allowed to state-change from the first separate state to the first contact state in a case where the driving force is equal to or greater than driving force to be generated by rotation of the motor at a second rotational speed, and the motor rotates at a third rotational speed and thereby generate the driving force in the first period and the second period, the third rotational speed being equal to or lower than the first rotational speed and equal to or lower than the second rotational speed.

(3)

The image forming apparatus according to (2), in which the third rotational speed is equal to the first rotational speed.

(4)

The image forming apparatus according to any one of (1) to (3), in which a first timing is same as or after a second timing, the first timing being an end timing of the first period, the second timing being an end timing of the second period.

(5)

The image forming apparatus according to (4), in which the fixing section state-changes from the second separate state to the second contact state one or more times in a period from the second timing to the first timing.

(6)

The image forming apparatus according to any one of (1) to (5), in which rotation of the motor in a first rotation direction causes each of the first rotating member and the second rotating member in the second contact state to rotate in a direction of conveying the medium away from the image formation-transfer section, and rotation of the motor in a second rotation direction repeatedly causes the first rotating member and the second rotating member to be in the second contact state and the second separate state alternately, the second rotation direction being opposite to the first rotation direction.

(7)

The image forming apparatus according to (6), in which the rotation of the motor in the first rotation direction causes the fixing section to perform the fixing operation while conveying the medium in the second contact state or causes the fixing section to perform warm-up operation in the second contact state.

(8)

The image forming apparatus according to (7), in which the rotation of the motor in the first rotation direction causes the image carrier and the transfer section in the image formation-transfer section to state-change from the first contact state to the first separate state, and the rotation of the motor in the second rotation direction causes the image carrier and the transfer section in the image formation-transfer section to state-change from the first separate state to the first contact state.

(9)

An image forming apparatus including:

a motor that generates driving force;

an image formation-transfer section that includes an image carrier and a transfer section, the image formation-transfer section state-changing between a first contact state and a first separate state by the driving force generated by the motor, the first contact state being a state in which the image carrier and the transfer section are in contact with each other, the first separate state being a state in which the image carrier and the transfer section are separated away from each other, the image formation-transfer section forming a developer image on a medium or the transfer section in the first contact state;

a switching mechanism that transmits and cuts off the driving force to the image formation-transfer section;

a fixing section that includes a first rotating member and a second rotating member, the fixing section state-changing between a second contact state and a second separate state by the driving force generated by the motor, the second contact state being a state in which the first rotating member and the second rotating member are in contact with each other, the second separate state being a state in which the first rotating member and the second rotating member are separated away from each other, the fixing section performing fixing operation in the second contact state, the fixing operation being operation of fixing the developer image to the medium; and a controller that controls the motor and the switching mechanism and thereby causes part or all of a third period and part or all of a fourth period to overlap each other, the third period being a period in which the fixing section performs warm-up operation in the second contact state, the fourth period being a period in which the image formation-transfer section state-changes from the first contact state to the first separate state.

(10)

The image forming apparatus according to (9), in which an end timing of the third period is same as or after an end timing of the fourth period.

(11)

The image forming apparatus according to (9) or (10), in which a start timing of the third period is same as or before a start timing of the fourth period.

(12)

The image forming apparatus according to any one of (9) to (11), in which rotation of the motor in a first rotation direction causes each of the first rotating member and the second rotating member in the second contact state to rotate in a direction of conveying the medium away from the image formation-transfer section, and rotation of the motor in a second rotation direction repeatedly causes the first rotating member and the second rotating member to be in the second contact state and the second separate state alternately, the second rotation direction being opposite to the first rotation direction.

(13)

The image forming apparatus according to (12), in which the rotation of the motor in the first rotation direction causes the fixing section to perform the fixing operation while conveying the medium in the second contact state or causes the fixing section to perform warm-up operation in the second contact state.

(14)

The image forming apparatus according to (13), in which the rotation of the motor in the first rotation direction causes the image carrier and the transfer section in the image formation-transfer section to state-change from the first contact state to the first separate state, and the rotation of the motor in the second rotation direction causes the image carrier and the transfer section in the image formation-transfer section to state-change from the first separate state to the first contact state.

(15)

An image forming apparatus including:

a motor that generates driving force;

an image formation-transfer section that includes an image carrier and a transfer section, the image formation-transfer section state-changing between a first state and a second state by the driving force generated by the motor, the first state being a state in which the image carrier and the transfer section are pressed against each other with pressure that is equal to or greater than first pressure, the second state including a state in which the image carrier and the transfer section are pressed against each other with pressure that is smaller than the first pressure and a state in which the image carrier and the transfer section are separated away from each other, the image formation-transfer section forming a developer image on a medium or the transfer section in the first state;

a switching mechanism that transmits and cuts off the driving force to the image formation-transfer section;

a fixing section that includes a first rotating member and a second rotating member, the fixing section state-changing between a third state and a fourth state by the driving force generated by the motor, the third state being a state in which the first rotating member and the second rotating member are pressed against each other with pressure that is equal to or greater than second pressure, the fourth state including a state in which the first rotating member and the second rotating member are pressed against each other with pressure that is smaller than the second pressure and a state in which the first rotating member and the second rotating member are separated away from each other, the fixing section performing fixing operation in the third state, the fixing operation being operation of fixing the developer image to the medium; and a controller that controls the motor and the switching mechanism and thereby causes part or all of a first period and part or all of a second period to overlap each other, the first period being a period in which the fixing section state-changes from the fourth state to the third state, the second period being a period in which the image formation-transfer section state-changes from the second state to the first state.

(16)

An image forming apparatus including:

a motor that generates driving force;

an image formation-transfer section that includes an image carrier and a transfer section, the image formation-transfer section state-changing between a first state and a second state by the driving force generated by the motor, the first state being a state in which the image carrier and the transfer section are pressed against each other with pressure that is equal to or greater than first pressure, the second state including a state in which the image carrier and the transfer section are pressed against each other with pressure that is smaller than the first pressure and a state in which the image carrier and the transfer section are separated away from each other, the image formation-transfer section forming a developer image on a medium or the transfer section in the first state;

a switching mechanism that transmits and cuts off the driving force to the image formation-transfer section;

a fixing section that includes a first rotating member and a second rotating member, the fixing section state-changing between a third state and a fourth state by the driving force generated by the motor, the third state being a state in which the first rotating member and the second rotating member are pressed against each other with pressure that is equal to or greater than second pressure, the fourth state including a state in which the first rotating member and the second rotating member are pressed against each other with pressure that is smaller than the second pressure and a state in which the first rotating member and the second rotating member are separated away from each other, the fixing section performing fixing operation in the third state, the fixing operation being operation of fixing the developer image to the medium; and a controller that controls the motor and the switching mechanism and thereby causes part or all of a third period and part or all of a fourth period to overlap each other, the third period being a period in which the fixing section performs warm-up operation in the third state, the fourth period being a period in which the image formation-transfer section state-changes from the first state to the second state.

In the image forming apparatus according to one embodiment of the technology, the image formation-transfer section state-changes between the first contact state and the first separate state by the driving force generated by the motor. The switching mechanism transmits and cuts off the driving force to the image formation-transfer section. The fixing section state-changes between the second contact state and the second separate state by the driving force generated by the motor. The controller controls the motor and the switching mechanism and thereby causes part or all of the first period and part or all of the second period to overlap each other. The first period is the period in which the fixing section state-changes from the second separate state to the second contact state. The second period is the period in which the image formation-transfer section state-changes from the first separate state to the first contact state. Accordingly, part or all of the first period in which the fixing section state-changes from the second separate state to the second contact state and part or all of the second period in which the image formation-transfer section state-changes from the first separate state to the first contact state overlap each other. As a result, it is possible to suppress an increase in a required time for warm-up operation of the image forming apparatus.

In the image forming apparatus according to one embodiment of the technology, the image formation-transfer section state-changes between the first contact state and the first separate state by the driving force generated by the motor. The switching mechanism transmits and cuts off the driving force to the image formation-transfer section. The fixing section state-changes between the second contact state and the second separate state by the driving force generated by the motor. The controller controls the motor and the switching mechanism and thereby causes part or all of the third period and part or all of the fourth period to overlap each other. The third period is the period in which the fixing section performs the warm-up operation in the second contact state. The fourth period is the period in which the image formation-transfer section state-changes from the first contact state to the first separate state. Accordingly, part or all of the third period in which the fixing section performs the warm-up operation in the second contact state and part or all of the fourth period in which the image formation-transfer section state-changes from the first contact state to the first separate state overlap each other. As a result, it is possible to suppress an increase in the required time for the warm-up operation of the image forming apparatus.

In the image forming apparatus according to one embodiment of the technology, the image formation-transfer section state-changes between the first state and the second state by the driving force generated by the motor. The switching mechanism transmits and cuts off the driving force to the image formation-transfer section. The fixing section state-changes between the third state and the fourth state by the driving force generated by the motor. The controller controls the motor and the switching mechanism and thereby causes part or all of the first period and part or all of the second period to overlap each other. The first period is the period in which the fixing section state-changes from the fourth state to the third state. The second period is the period in which the image formation-transfer section state-changes from the second state to the first state. Accordingly, part or all of the first period in which the fixing section state-changes from the fourth state to the third state and part or all of the second period in which the image formation-transfer section state-changes from the second state to the first state overlap each other. As a result, it is possible to suppress an increase in the required time for the warm-up operation of the image forming apparatus.

In the image forming apparatus according to one embodiment of the technology, the image formation-transfer section state-changes between the first state and the second state by the driving force generated by the motor. The switching mechanism transmits and cuts off the driving force to the image formation-transfer section. The fixing section state-changes between the third state and the fourth state by the driving force generated by the motor. The controller controls the motor and the switching mechanism and thereby causes part or all of the third period and part or all of the fourth period to overlap each other. The third period is the period in which the fixing section performs the warm-up operation in the third state. The fourth period is the period in which the image formation-transfer section state-changes from the first state to the second state. Accordingly, part or all of the third period in which the fixing section performs the warm-up operation in the third state and part or all of the fourth period in which the image formation-transfer section state-changes from the first state to the second state overlap each other. As a result, it is possible to suppress an increase in the required time for the warm-up operation of the image forming apparatus.

According to the image forming apparatus of one embodiment of the technology, it is possible to suppress an increase in the required time for the warm-up operation also in a case where the number of motors is reduced.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

a motor that generates driving force;

an image formation-transfer section that includes an image carrier and a transfer section, the image formation-transfer section state-changing between a first contact state and a first separate state by the driving force generated by the motor, the first contact state being a state in which the image carrier and the transfer section are in contact with each other, the first separate state being a state in which the image carrier and the transfer section are separated away from each other, the image formation-transfer section forming a developer image on a medium or the transfer section in the first contact state;

a switching mechanism that transmits and cuts off the driving force to the image formation-transfer section;

a fixing section that includes a first rotating member and a second rotating member, the fixing section state-changing between a second contact state and a second separate state by the driving force generated by the motor, the second contact state being a state in which the first rotating member and the second rotating member are in contact with each other, the second separate state being a state in which the first rotating member and the second rotating member are separated away from each other, the fixing section performing fixing operation in the second contact state, the fixing operation being operation of fixing the developer image to the medium; and a controller that controls the motor and the switching mechanism and thereby causes part or all of a first period and part or all of a second period to overlap each other, the first period being a period in which the fixing section state-changes from the second separate state to the second contact state, the second period being a period in which the image formation-transfer section state-changes from the first separate state to the first contact state, wherein a first timing is same as or after a second timing, the first timing being an end timing of the first period, the second timing being an end timing of the second period, the fixing section state-changes from the second separate state to the second contact state one or more times in a period from the second timing to the first timing, and rotation of the motor in a first rotation direction causes each of the first rotating member and the second rotating member in the second contact state to rotate in a direction of conveying the medium away from the image formation-transfer section, and rotation of the motor in a second rotation direction repeatedly causes the first rotating member and the second rotating member to be in the second contact state and the second separate state alternately, the second rotation direction being opposite to the first rotation direction.

2. The image forming apparatus according to claim 1, wherein the fixing section is allowed to state-change from the second separate state to the second contact state in a case where the driving force generated by the motor is equal to or greater than driving force to be generated by rotation of the motor at a first rotational speed, the image formation-transfer section is allowed to state-change from the first separate state to the first contact state in a case where the driving force is equal to or greater than driving force to be generated by rotation of the motor at a second rotational speed, and the motor rotates at a third rotational speed and thereby generate the driving force in the first period and the second period, the third rotational speed being equal to or lower than the first rotational speed and equal to or lower than the second rotational speed.

3. The image forming apparatus according to claim 2, wherein the third rotational speed is equal to the first rotational speed.

4. The image forming apparatus according to claim 1, wherein the rotation of the motor in the first rotation direction causes the fixing section to perform the fixing operation while conveying the medium in the second contact state or causes the fixing section to perform warm-up operation in the second contact state.

5. The image forming apparatus according to claim 4, wherein the rotation of the motor in the first rotation direction causes the image carrier and the transfer section in the image formation-transfer section to state-change from the first contact state to the first separate state, and the rotation of the motor in the second rotation direction causes the image carrier and the transfer section in the image formation-transfer section to state-change from the first separate state to the first contact state.

* * * * *